US010028571B2

(12) United States Patent
Wu

(10) Patent No.: US 10,028,571 B2
(45) Date of Patent: Jul. 24, 2018

(54) BACKPACK STRUCTURE INTEGRATED WITH A TENT STRUCTURE THEREIN

(71) Applicant: Ming-Yuan Wu, Taipei (TW)

(72) Inventor: Ming-Yuan Wu, Taipei (TW)

( * ) Notice: Subject to any disclaimer, the term of this patent is extended or adjusted under 35 U.S.C. 154(b) by 97 days.

(21) Appl. No.: 15/208,977

(22) Filed: Jul. 13, 2016

(65) Prior Publication Data

US 2017/0112267 A1 Apr. 27, 2017

(30) Foreign Application Priority Data

Oct. 26, 2015 (TW) ..... 104217132 U

(51) Int. Cl.

| | |
|---|---|
| ***A45F 4/04*** | (2006.01) |
| ***E04H 15/02*** | (2006.01) |
| ***E04H 15/30*** | (2006.01) |
| ***A45F 3/04*** | (2006.01) |
| ***A45C 5/14*** | (2006.01) |
| ***A45C 13/10*** | (2006.01) |
| ***E04H 15/18*** | (2006.01) |
| ***E04H 15/32*** | (2006.01) |
| ***E04H 15/40*** | (2006.01) |
| ***E04H 15/54*** | (2006.01) |
| ***E04H 15/56*** | (2006.01) |
| ***E04H 15/58*** | (2006.01) |

(Continued)

(52) U.S. Cl.

CPC ..... *A45F 4/04* (2013.01); *A45C 5/143* (2013.01); *A45C 13/1076* (2013.01); *A45F 3/04* (2013.01); *E04H 15/02* (2013.01); *E04H 15/18* (2013.01); *E04H 15/30* (2013.01); *E04H 15/322* (2013.01); *E04H 15/40* (2013.01); *E04H 15/54* (2013.01); *E04H 15/56* (2013.01); *E04H 15/58* (2013.01); *E04H 15/62* (2013.01); *E04H 15/64* (2013.01)

(58) Field of Classification Search

CPC ..... A45F 4/04; A45F 4/06; A45F 4/08; E04H 15/02; E04H 15/30; E04H 15/00

USPC ..... 224/154; 135/95

See application file for complete search history.

(56) References Cited

U.S. PATENT DOCUMENTS 385,657 A * 7/1888 Blanchard ..... A45F 4/04 224/154

460,896 A * 10/1891 Stiter ..... A45F 4/04 135/115

(Continued)

FOREIGN PATENT DOCUMENTS

WO WO 2007109049 A2 * 9/2007 ..... A45F 4/06

*Primary Examiner* — Justin Larson

(57) ABSTRACT

A backpack structure is adapted to provide a storage space, and integrated with a tent structure. The backpack body has a right connection portion and a left connection portion to connect the left sidewall and the right sidewall, wherein the connections are pins, buttons, strips or velcros. The tent structure is stored in the compartment of the backpack body, or the left sidewall and the right sidewall. The tent structure includes a tent base, a left tent portion and a right tent portion. The compartment may has pads, made of cushioning materials, such as foam, to replace the camping mat, for rest. Therefore, the backpack structure of the invention is light for the users of outdoor activities. Moreover, the backpack structure may combine with a trolley structure for drawing easily, or the backpack structure may be designed as a luggage suitcase.

21 Claims, 30 Drawing Sheets

(51) Int. Cl.
*E04H 15/64* (2006.01)
*E04H 15/62* (2006.01)

(56) References Cited

U.S. PATENT DOCUMENTS 2,531,501 A * 11/1950 Cline ..... A45C 3/10 135/116
3,847,170 A * 11/1974 Anderson ..... E04H 15/30 135/116
4,355,649 A * 10/1982 Deragon ..... E04H 15/06 135/88.13
4,418,854 A * 12/1983 Genovese ..... B62J 11/00 224/154
4,883,206 A * 11/1989 Miller ..... A45F 4/04 135/96
4,885,812 A * 12/1989 Lindner ..... A47C 17/82 135/903
5,226,261 A * 7/1993 Wilbourn ..... B60J 7/102 52/2.21
5,277,349 A * 1/1994 Rowe ..... A45F 4/04 135/96
5,636,478 A * 6/1997 Chen ..... E04H 15/20 135/116
7,051,908 B2 * 5/2006 Mignano ..... A45F 4/02 224/153
8,434,653 B2 * 5/2013 Clark ..... A45F 4/06 224/154
8,695,859 B1 * 4/2014 Stalker ..... A45F 3/04 135/901
2003/0074845 A1 * 4/2003 Sample ..... E04H 1/1277 52/63
2004/0221392 A1 * 11/2004 Tsai ..... A45F 4/02 5/626
2008/0237281 A1 * 10/2008 Robinson ..... A45F 4/04 224/154
2010/0032459 A1 * 2/2010 Clark ..... A45F 4/06 224/154
2013/0333737 A1 * 12/2013 Williams ..... E04H 15/18 135/97
2014/0299638 A1 * 10/2014 Hutchins ..... A45F 4/08 224/154
2017/0112267 A1 * 4/2017 Wu ..... A45F 4/04

* cited by examiner

BACKPACK STRUCTURE INTEGRATED WITH A TENT STRUCTURE THEREIN

BACKGROUND OF THE INVENTION

Field of Invention

The present invention claims the foreign priority of TW 104217132, filed on Oct. 26, 2015. It relates to a backpack structure, and more particularly, but not exclusively to a backpack structure integrated with a tent structure and adapted for outdoor activities.

Related Art

Due to the life stress and heavy work pressure, the outdoor activities are popular in Europe and America. More and more families in the weekly are willing to prepare to experience camping tools for outdoor life.

The outdoor activities may reduce the times to stay at home or office computer all day and work under pressure. The camping with the following benefits: Reconnect with nature, Learn social skills, Grow more independent, Develop life-long skills, Gain resiliency, and Experience success and become more confident.

When doing outdoor activities together, the users may take the backpack for outdoor activities, such as mountain climbing, and camping kits, including tent frames, an outer shell, an inner shell and tent pegs. All of these camping kits have to be packed by another backpack. Therefore, the equipment for the users are too heavy to move.

There has backpack structure to integrated with the tent structure in conventional art. However, due to the tent structure occupies much space of the backpack, the users still to take another backpack to carry other things. Therefore, there is a need to integrate the tent structure to the backpack structure well to remain the original function of carrying objections for the backpack.

SUMMARY OF THE INVENTION

The present invention overcomes the above-described and other problems and disadvantages in the prior art by providing a backpack structure integrated with the tent structure, with the function of carrying objections for the backpack is still remained.

Accordingly, the present invention provides a backpack structure. The backpack structure is adapted to provide a storage space, and includes a backpack body, a left sidewall and a right sidewall. The backpack body has a right connection portion and a left connection portion. The left sidewall is connected to the backpack body by the left connection portion and the right sidewall is connected to the backpack body by the right connection portion, wherein the connections are pins, buttons, strips or velcros. The tent structure is stored in the compartment of the backpack body, or the left sidewall and the right sidewall. The tent structure includes a tent base, a left tent portion and a right tent portion. The compartment may has pads, made of cushioning materials, such as foam, to replace the camping mat, for rest. Therefore, the backpack structure of the invention is light for the users of outdoor activities.

The tent base may be printed a variety of printed patterns to improve entertainments, such as chess, or table games. The users may use the printed patterns to play the related game during outdoor activities. On the other hand, the left tent portion or the right tent portion may combine with the tent frame to form a goalmouth for playing balls. The front cover strap is disposed to the front cover to adjust the length of the front cover. Therefore, the front cover may use to hold a sleeping bag or a mat to enhance the convenience for carrying objections. Moreover, the backpack structure may combine with a trolley structure for drawing easily, or the backpack structure may be designed as a luggage suitcase.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
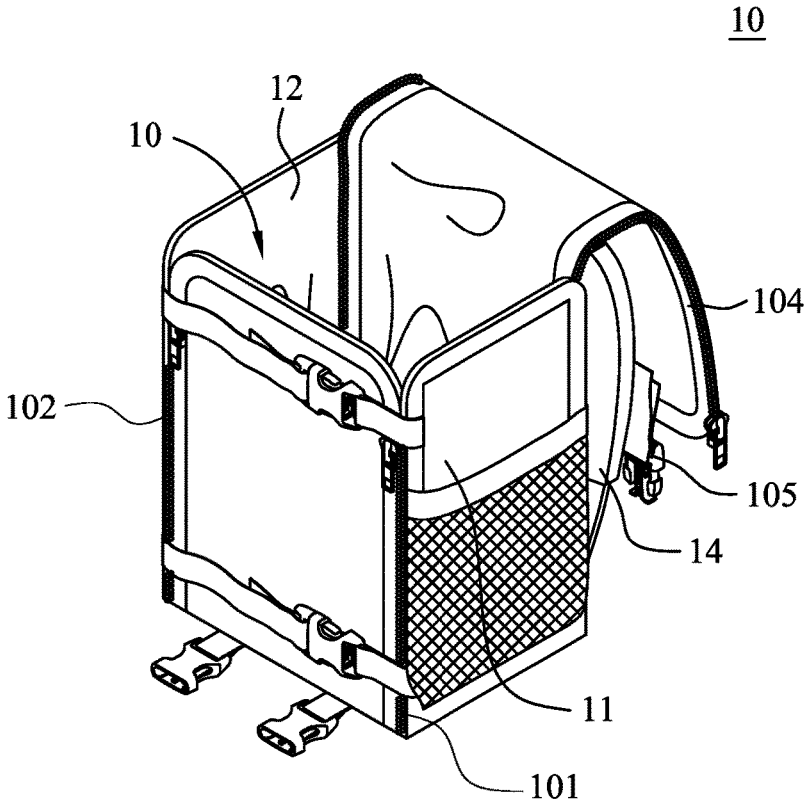
FIG. 1 is a schematic view of the backpack structure of the present invention.

The backpack structure according to the present invention is integrated with the tent structure with the function of carrying objections for the backpack. Please refer to FIG. 1, a schematic view of the backpack structure of the present invention is shown.

The backpack structure of the present invention is adapted to provide a storage space, and includes a backpack body 10, a left sidewall 11 and a right sidewall 12. The backpack body 10 has a right connection portion and a left connection portion. The left sidewall 11 is connected to the backpack body 10 by the left connection portion and the right sidewall 12 is connected to the backpack body 10 by the right connection portion. The back of the backpack body 10 may have shoulder straps 14. The above-mentioned elements may form the appearance of a backpack. The right connection portion and the left connection portion may use a zipper structure to integrate with the backpack body 10.

Figure 2A:
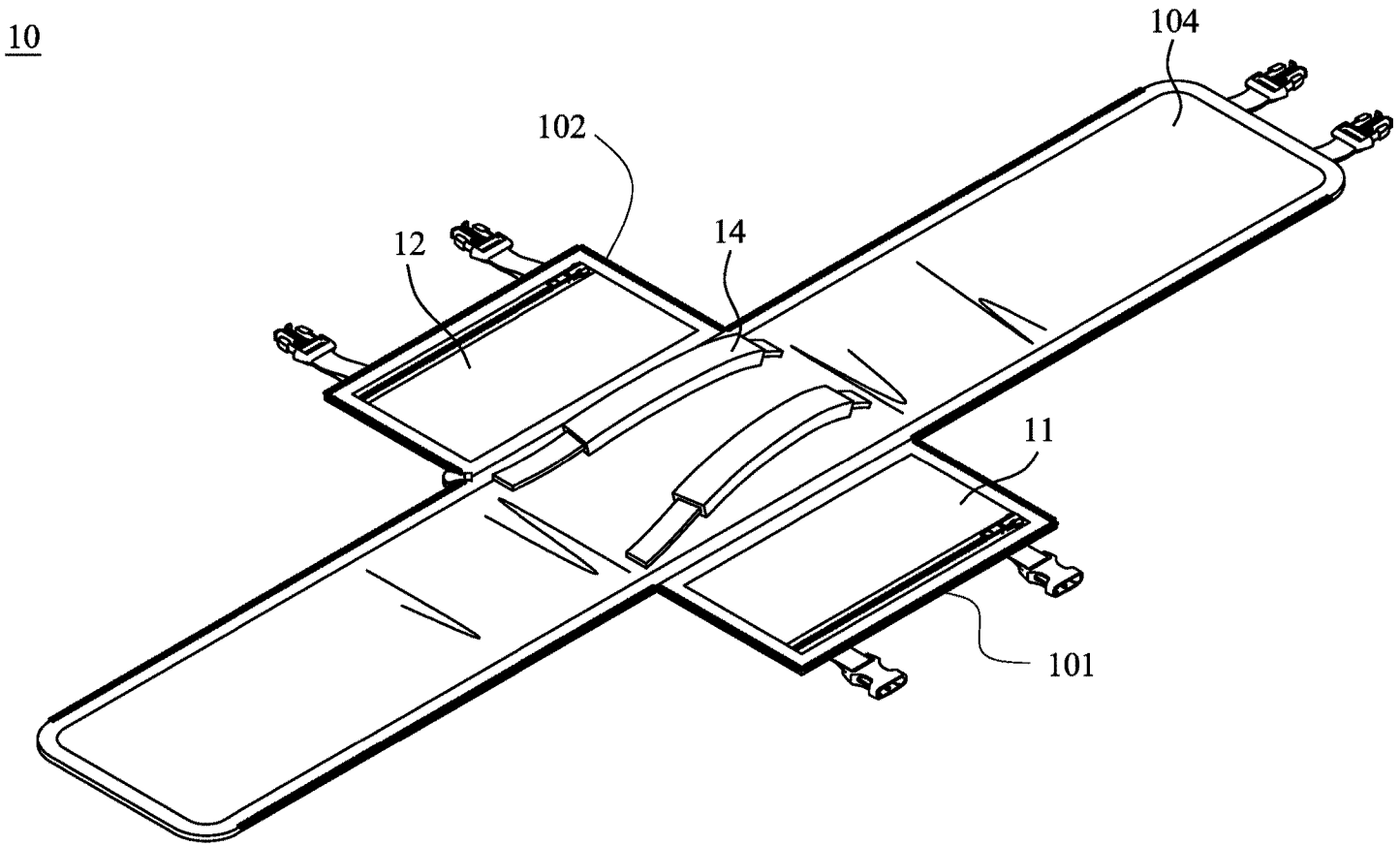
FIGS. 2A and 2B are schematic views of the backpack structure of the present invention, showing the backpack body is unfolded.
Figure 2B:
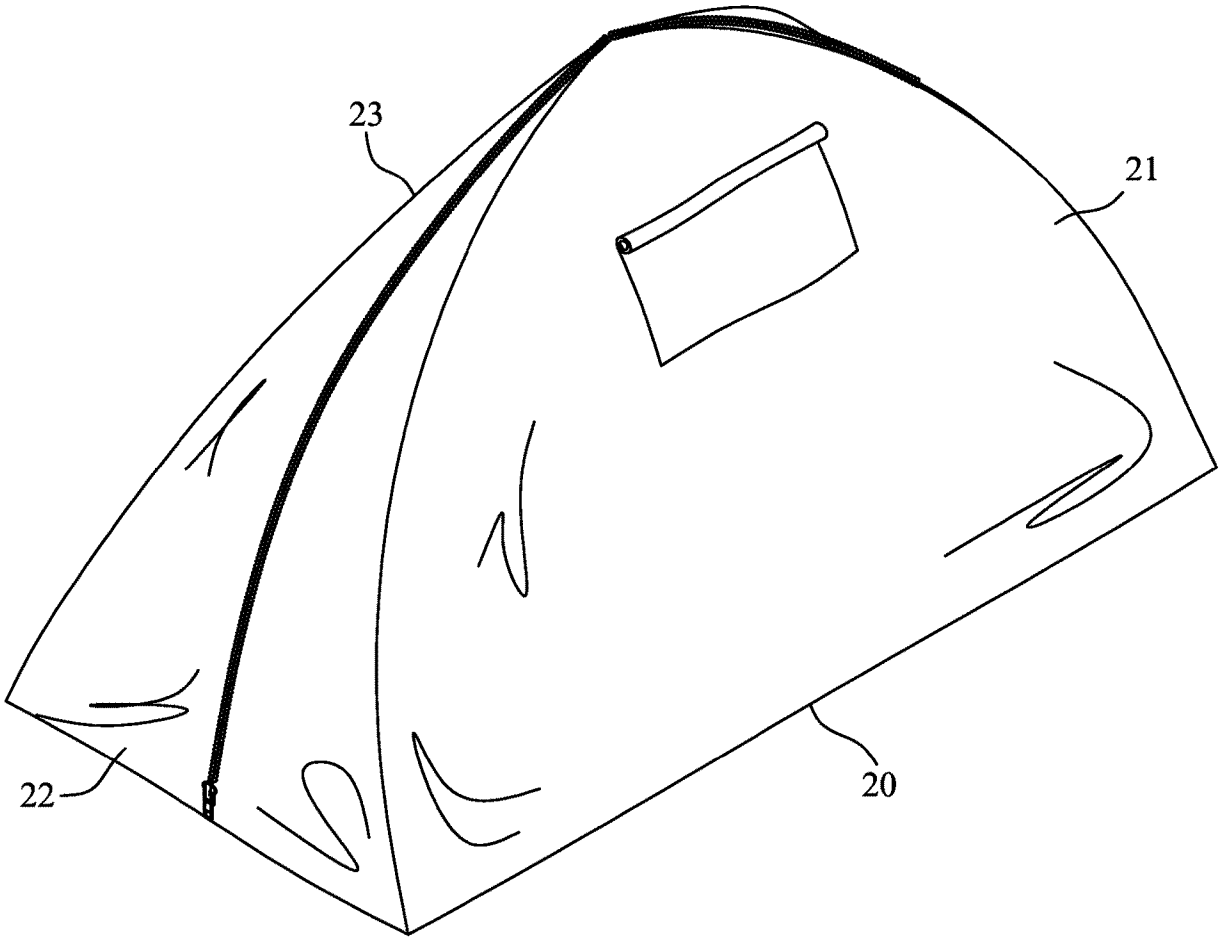

When the left sidewall 11 and the right sidewall 12 are detached form the right connection portion 102 and the left connection portion 101, the backpack body 10 is fully unfolded. The tent structure is stored in the compartment of the backpack body 10, or the left sidewall 11 and the right sidewall 12. The tent structure includes a tent base 20 and a plurality of tent shells. As shown, the tent shells include a left tent portion 21 and a right tent portion 22. After unfolded, the left tent portion 21 is connected to the right tent portion 22 and supported by tent frames 23 to form an inside space. The compartment may has pads, made of cushioning materials, such as foam, to replace the camping mat. The above-mentioned are shown in FIGS. 2A and 2B, which are schematic views of the backpack structure of the present invention, showing the backpack body is unfolded.

Figure 3:
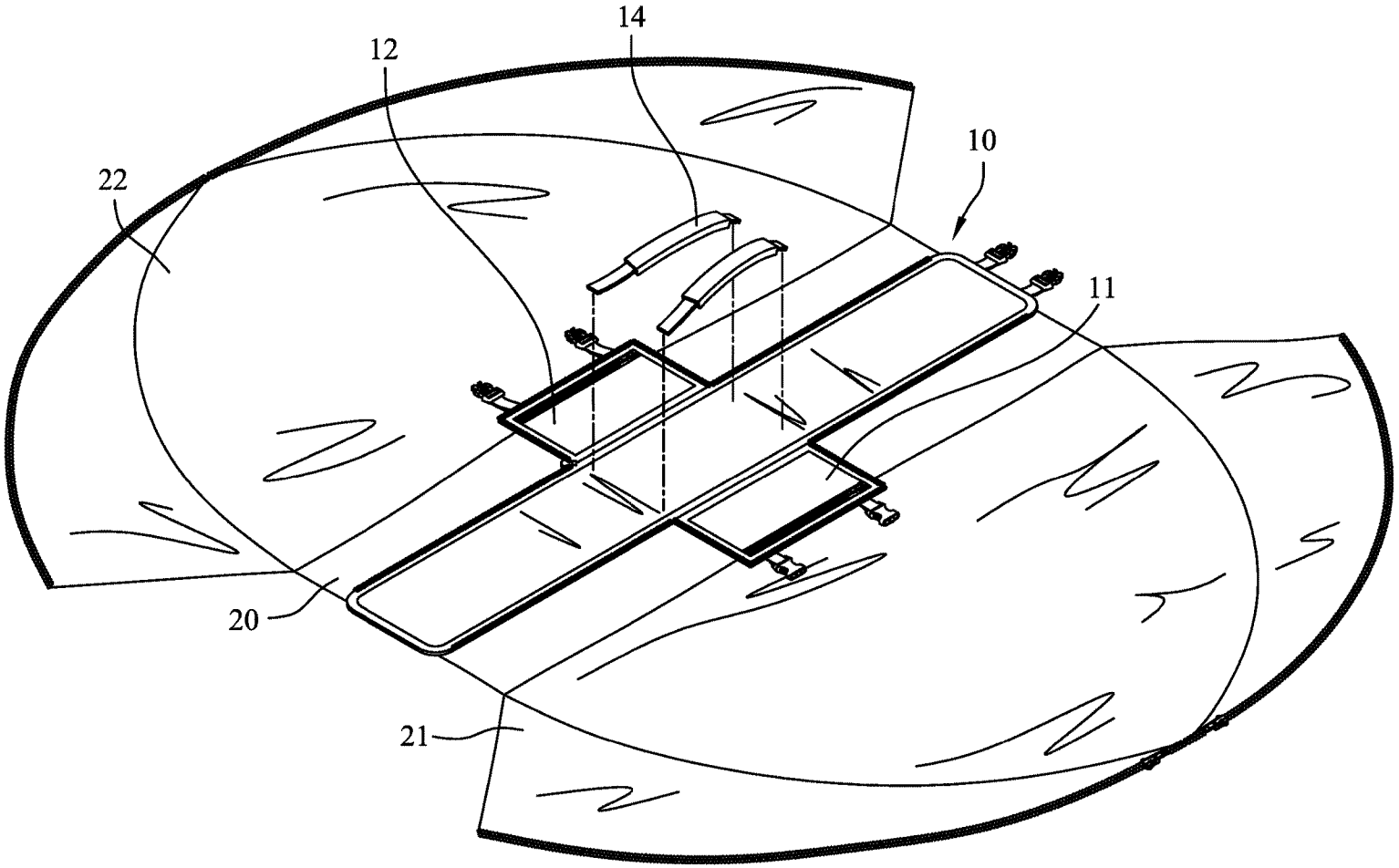
FIG. 3 is an exploded view of the backpack structure of the present invention.

Please refer to FIG. 3, which is an exploded view of the backpack structure of the present invention. The backpack structure of the present invention includes a backpack body 10, a left sidewall 11 and a right sidewall 12. The shoulder straps 14 are detachable from the backpack body 10. The stored tent structure includes a tent base 20 and a plurality of tent shells. As shown, the tent shells include a left tent portion 21 and a right tent portion 22. The tent shells are connected to the tent base 10 to form an inside space. The sizes of the tent base 20 and the tent shells are modified to build a single tent or a double tent for users to rest.

Figure 4:
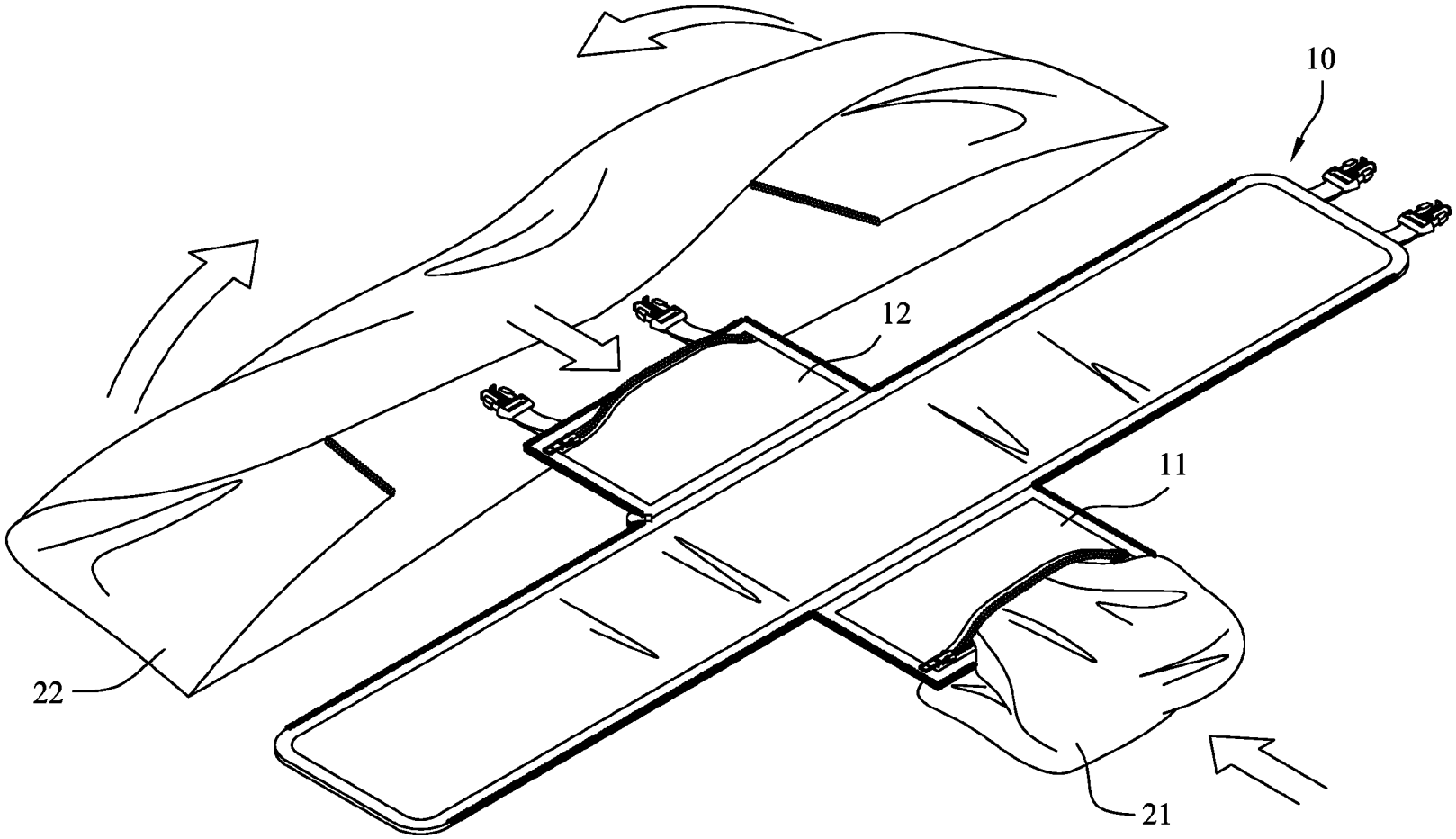
FIG. 4 is a schematic view of a first embodiment of the backpack structure of the present invention.

Please refer to FIG. 4, which is a schematic view of a first embodiment of the backpack structure of the present invention. The left tent portion 21 and the right tent portion 22 may be stored in the compartment of the backpack body 10, or the left sidewall 11 and the right sidewall 12. And the tent base 20 is stored in the compartment of the backpack body 10. When using, the tent base 20, the left tent portion 21 and the right tent portion 22 are taken out to be supported by tent frames to form a tent structure.

Figure 5:
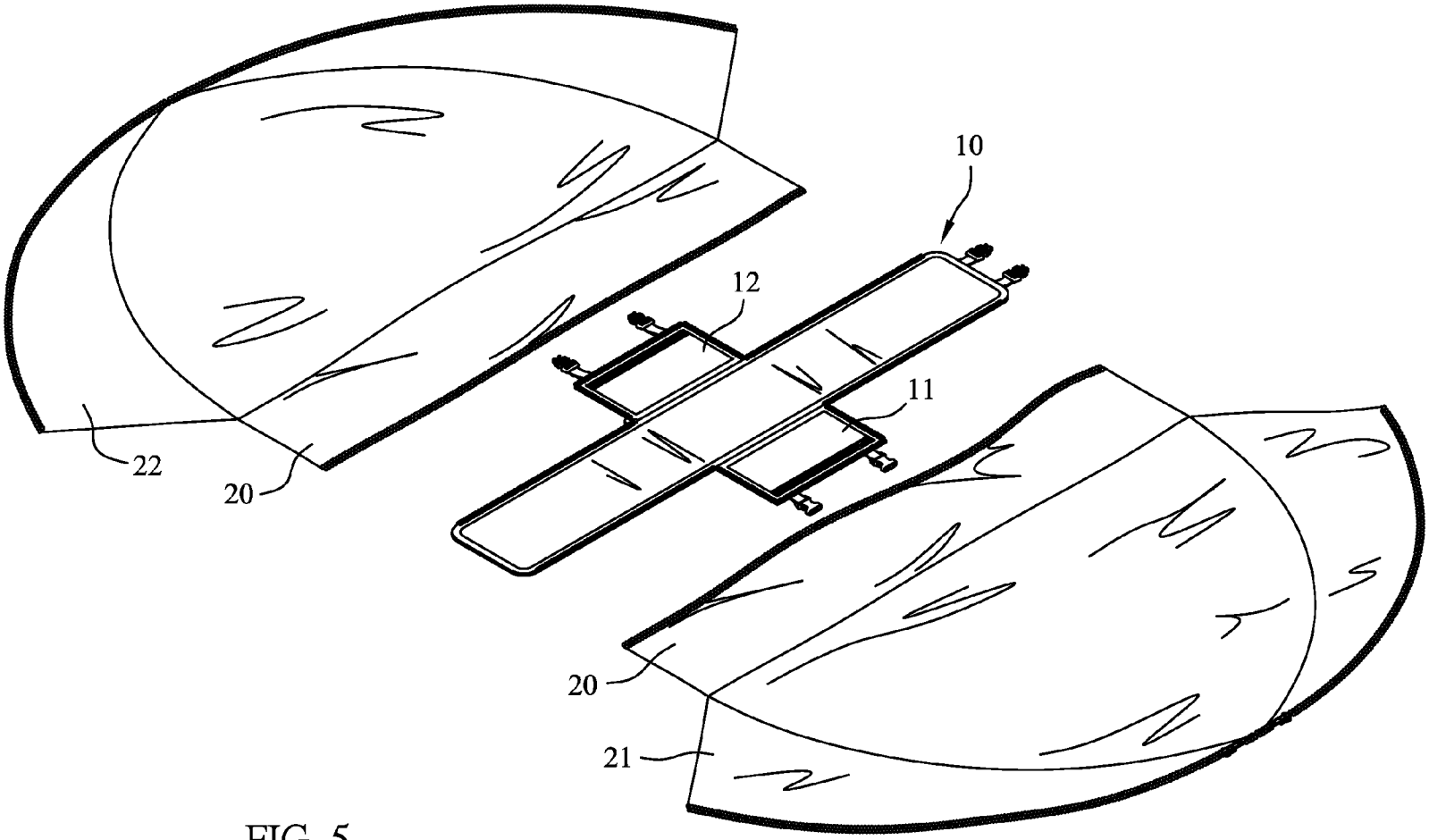
FIG. 5 is a schematic view of a second embodiment of the backpack structure of the present invention.

Please refer to FIG. 5, which is a schematic view of a second embodiment of the backpack structure of the present invention. The tent base 20, the left tent portion 21 and the right tent portion 22 have at least one connecting portion 211. The connecting portion 211 is used to connect to a corresponding connecting portion of the backpack structure. Therefore, the tent base 20, the left tent portion 21 and the right tent portion 22 are detachable from the backpack structure. If there does not have camping during the trip, the tent base 20, the left tent portion 21 and the right tent portion 22 can be taken off to reduce the loads of the backpack structure. The connecting portion 211 is attached to the corresponding connecting portion by using, such as but not limited buttons, zippers, or velcro.

Figure 6:
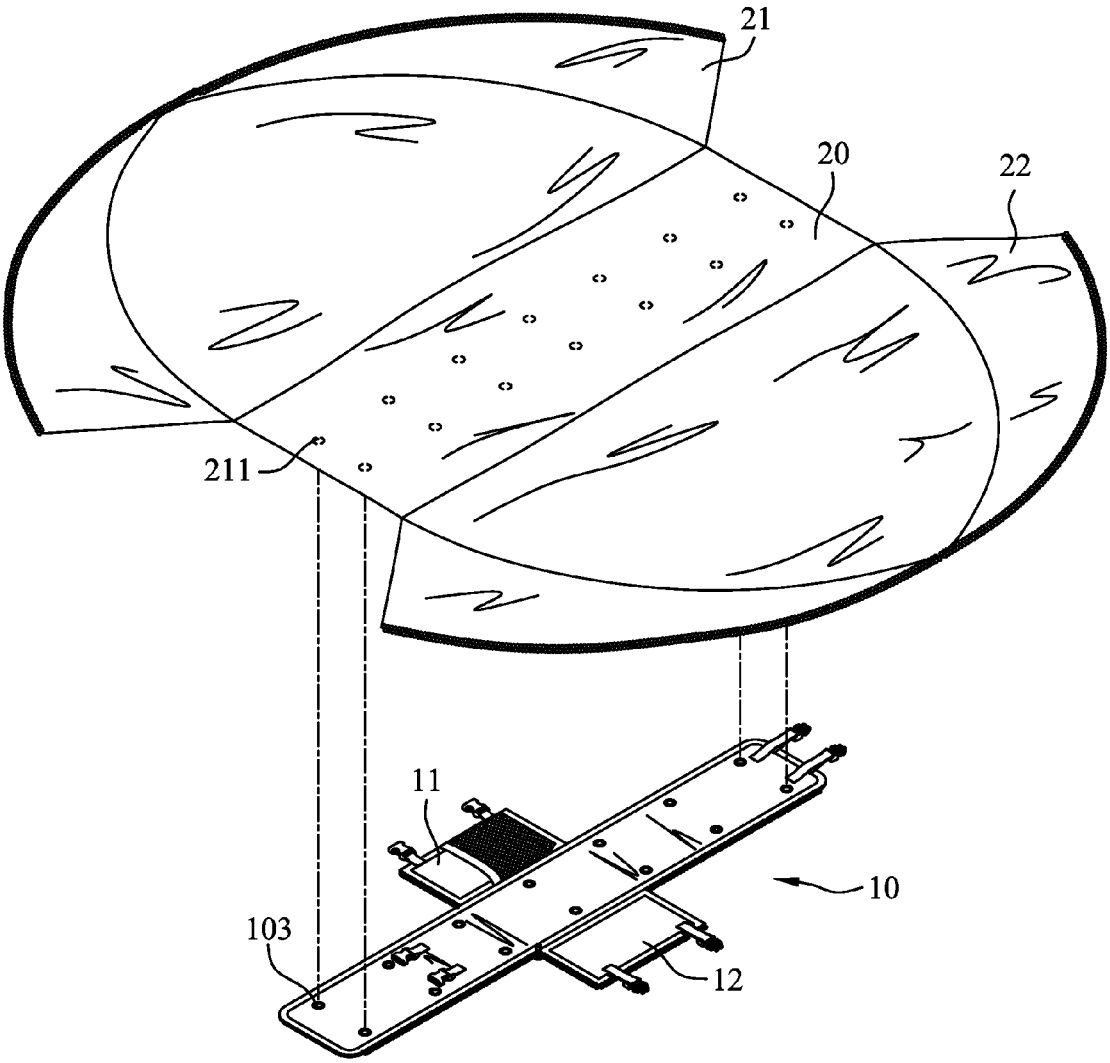
FIG. 6 is a schematic view of a third embodiment of the backpack structure of the present invention.

Please refer to FIG. 6, which is a schematic view of a third embodiment of the backpack structure of the present invention. The left tent portion 21 and the right tent portion 22 may be integrated together to reduce the amount of the elements of the tent structure. The tent structure still has the connecting portion 211. The connecting portion 211 is used to connect to a corresponding connecting portion 103 of the backpack structure. Therefore, the tent base 20 is detachable from the backpack structure to be carried if necessary.

Figure 7A:
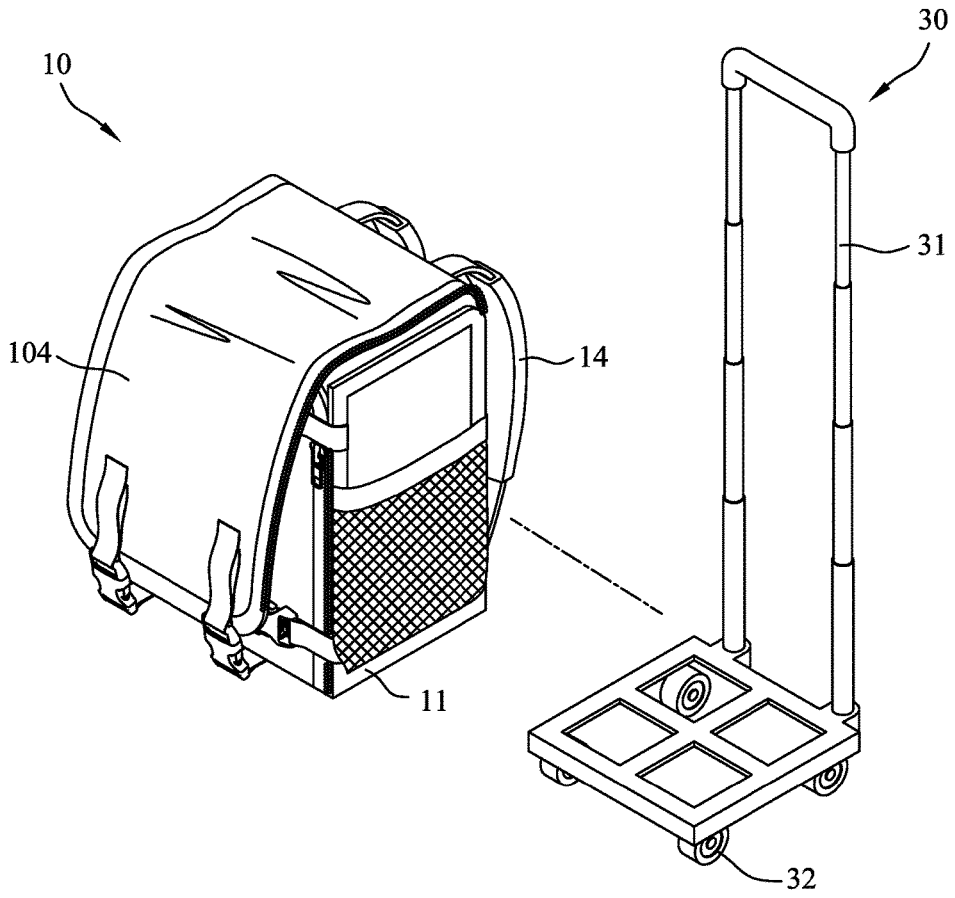
FIGS. 7A and 7B are schematic views of the backpack structure with a trolley structure of the present invention.
Figure 7B:
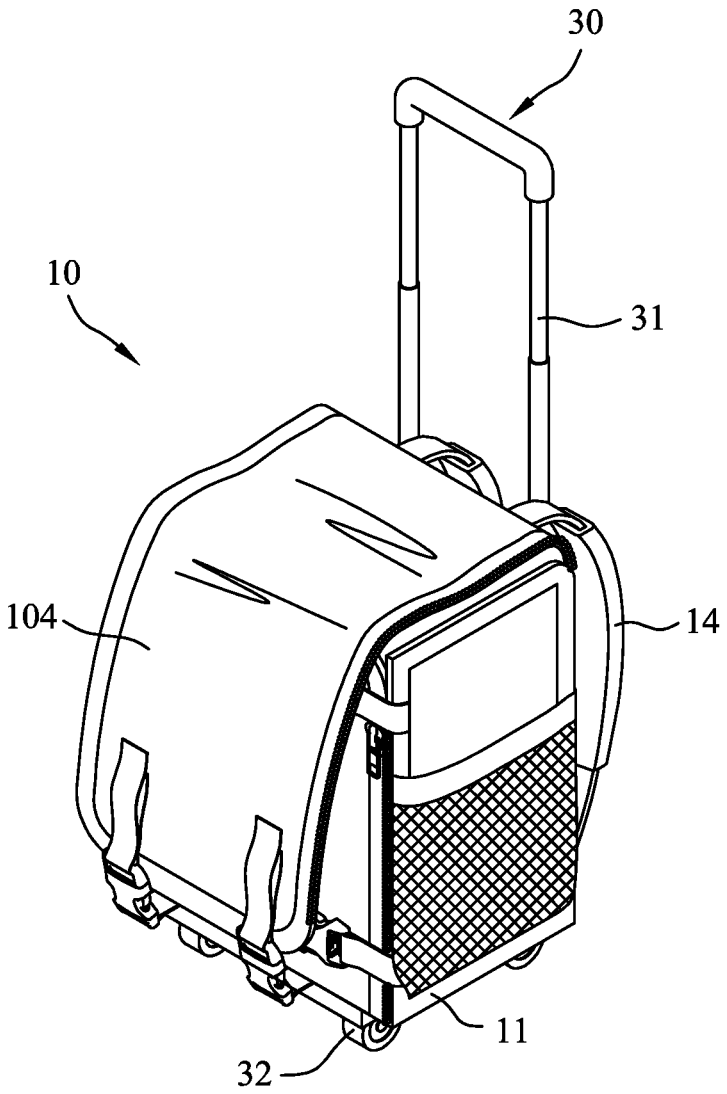

FIGS. 7A and 7B are schematic views of the backpack structure with a trolley structure of the present invention. The backpack structure includes a snap structure, not shown, to connect to a trolley structure 30. The trolley structure 30 includes a trolley 31 and a plurality of wheels 32. When the backpack structure is connect to the trolley structure 30 by the snap structure, the backpack structure may be dragged. The trolley 31 can be designed to be adjustable, and the trolley 31 and the wheels 32 may be designed to be foldable.

Figure 8:
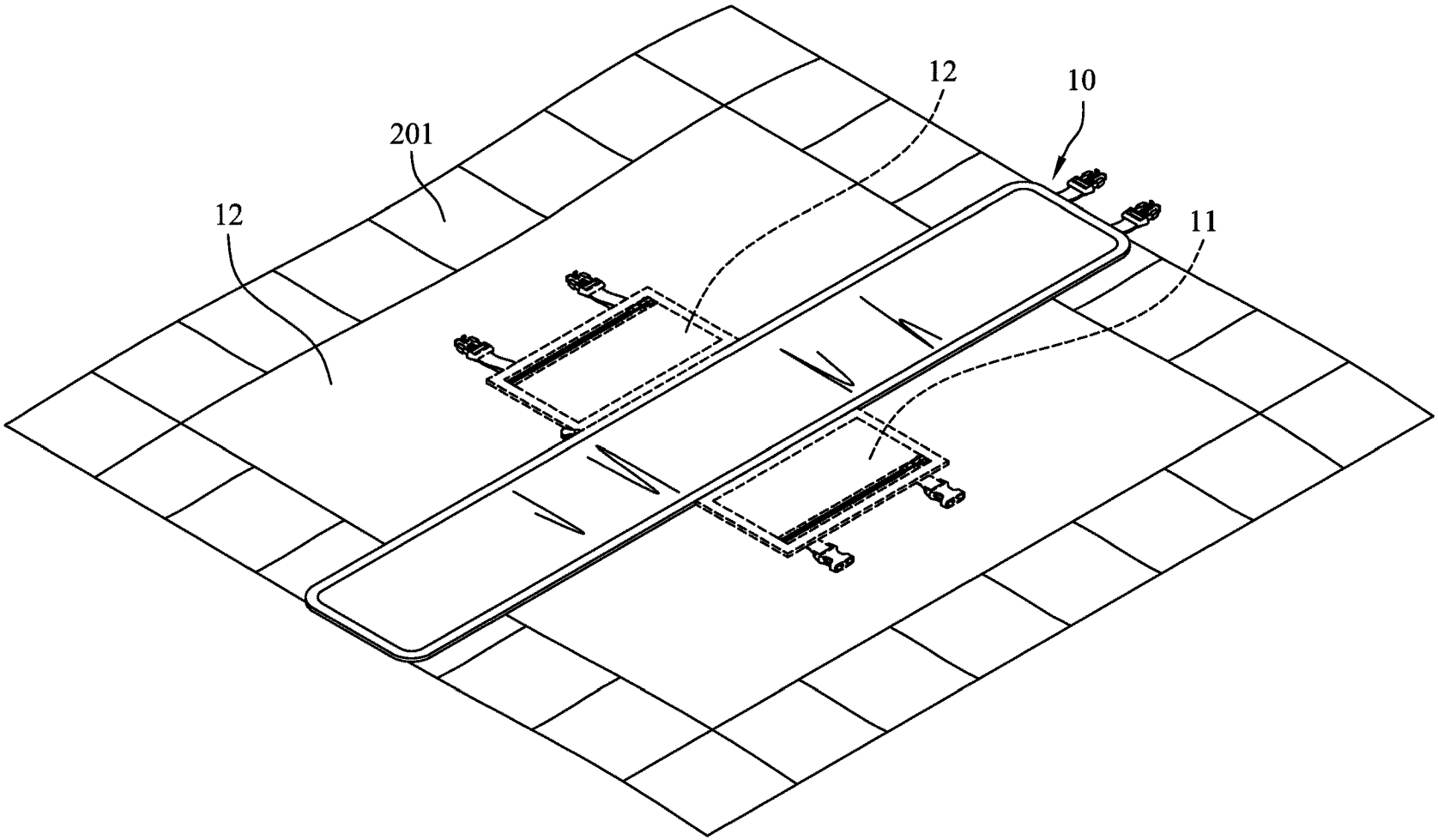
FIG. 8 is a schematic view of the tent base of the backpack structure of the present invention.
Figure 9:
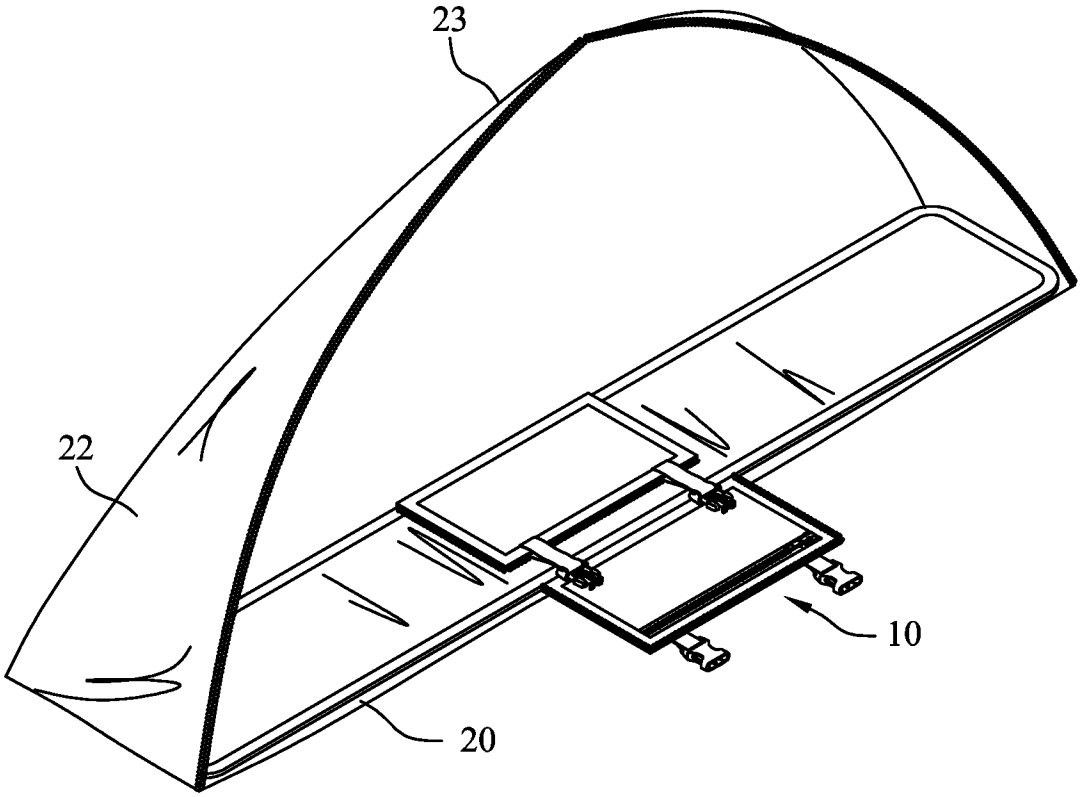
FIG. 9 is a schematic view of the tent shell of the backpack structure of the present invention.

Please refer to FIG. 8, which is a schematic view of the tent base of the backpack structure of the present invention. The tent base may be printed a variety of printed patterns 201 to improve entertainments, such as chess, or table games. The users may use the printed patterns 201 to play the related game during outdoor activities. On the other hand, the left tent portion 21 or the right tent portion 22 may combine with the tent frame 23 to form a goalmouth for playing balls. Please refer to FIG. 9, which is a schematic view of the tent shell of the backpack structure of the present invention.

Figure 10:
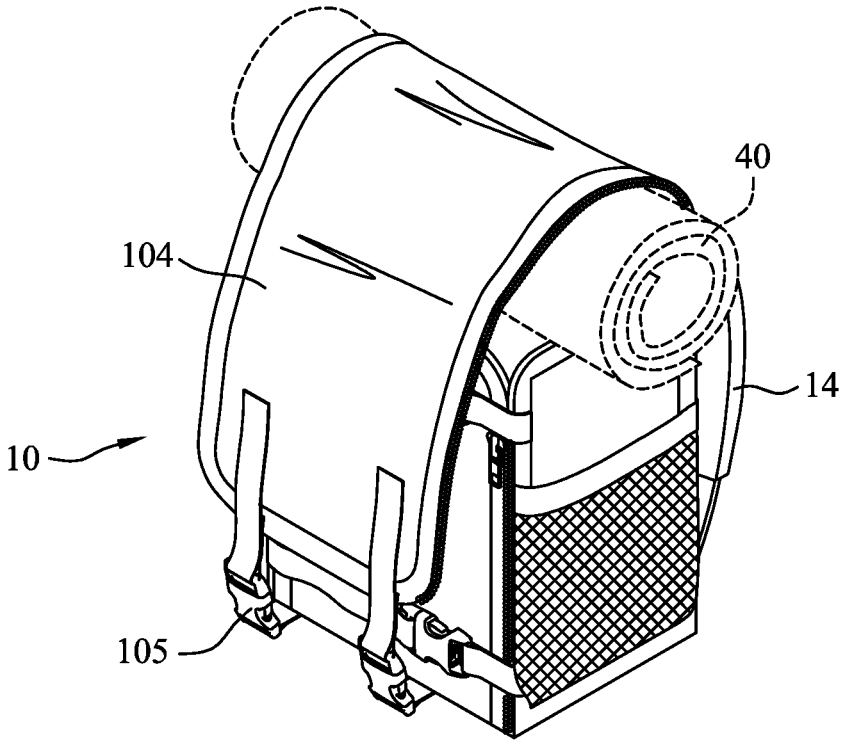
FIG. 10 is a schematic view of the front cover of the backpack structure of the present invention.

Please refer to FIG. 10, which is a schematic view of the front cover of the backpack structure of the present invention. The backpack body 10 further includes a front cover 104 to shield the opening. A front cover strap 105 is disposed to the front cover 104 to adjust the length of the front cover 104. Therefore, the front cover 104 may use to hold a sleeping bag 40 or a mat to enhance the convenience for carrying objections.

Figure 11A:
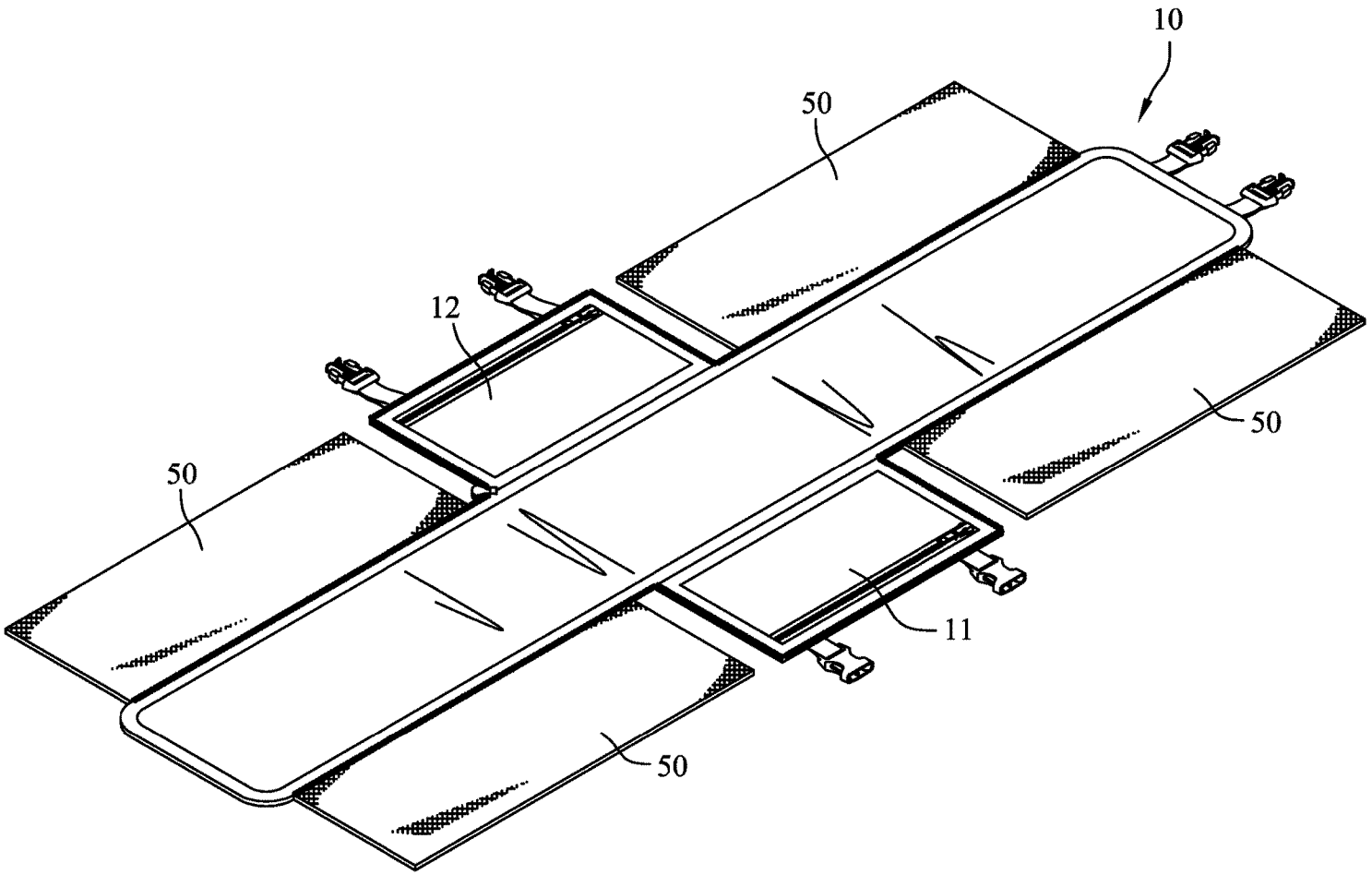
FIGS. 11A and 11B are schematic views of the backpack structure with a pad structure of the present invention.
Figure 11B:
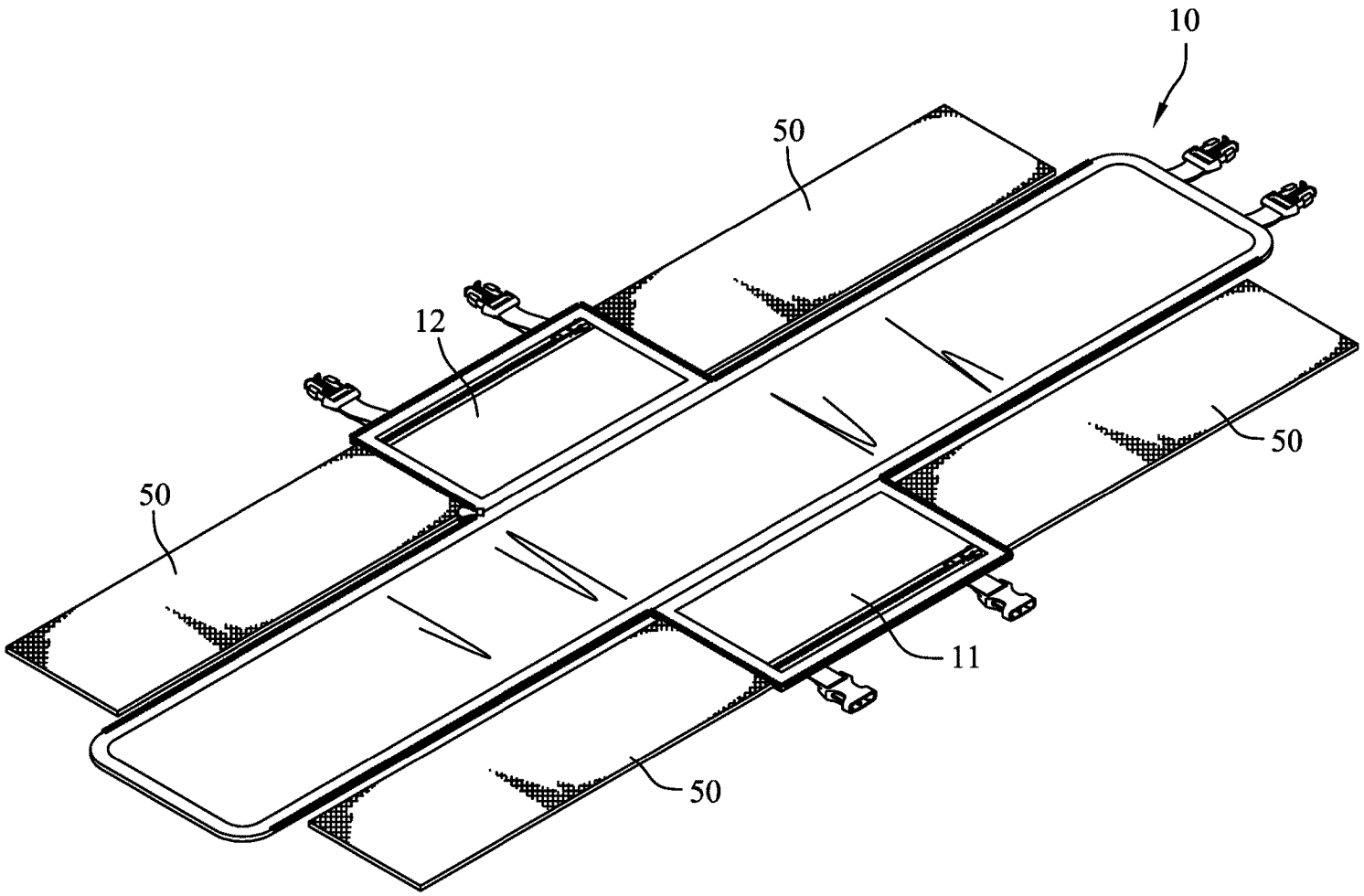
Figure 12:
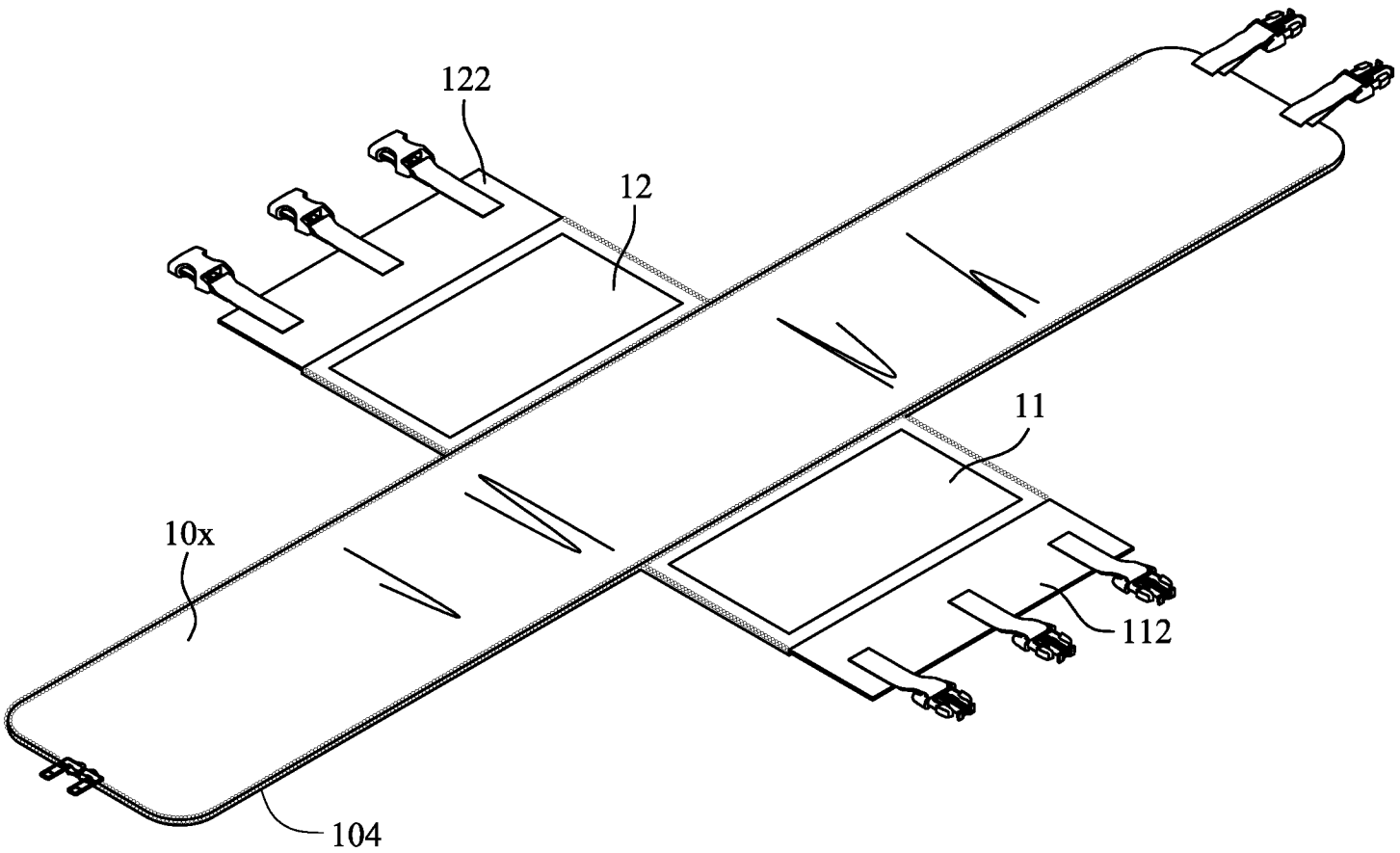
FIGS. 12-15 are schematic views of a forth embodiment of the backpack structure of the present invention.
Figure 13:
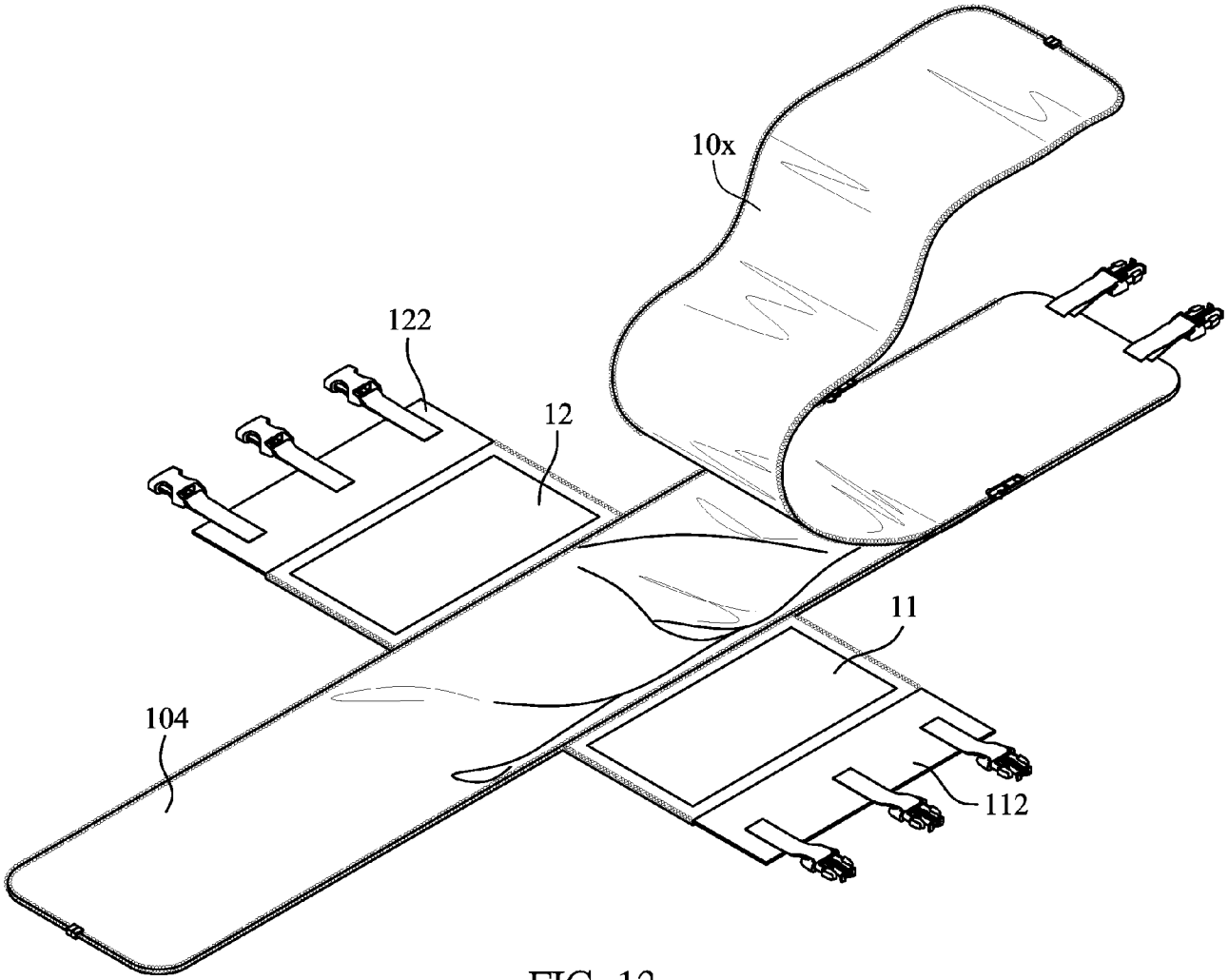

FIGS. 11A and 11B are schematic views of the backpack structure with a pad structure of the present invention. The backpack body 10 further includes a pad structure. The pad structure includes pads 50 made of cushioning material. The pads 50 are folded and stored within the compartment of the backpack body 10, shown in FIG. 11A, or within the compartment of the left sidewall 11 and the right sidewall 12, shown in FIG. 11B. In using, the pads 50 are taken off and unfolded to the pad structure to replace the camping mat.

FIGS. 12-15 are schematic views of a forth embodiment of the backpack structure of the present invention. The backpack structure of the present invention is adapted to provide a storage space, and includes a backpack body 10, a left sidewall 11 and a right sidewall 12. The backpack body 10 has a right connection portion and a left connection portion. The left sidewall 11 is connected to the backpack body 10 by the left connection portion and the right sidewall 12 is connected to the backpack body 10 by the right connection portion. When the left sidewall 11 and the right sidewall 12 are disconnected from the backpack body 10, the backpack body 10 are fully unfolded to a long strap form. The tent structure is stored within the compartment of the backpack body 10 and may be taken off by opening the compartment. The compartment is fixed by the buttons, zippers, or velcro.

Figure 14:
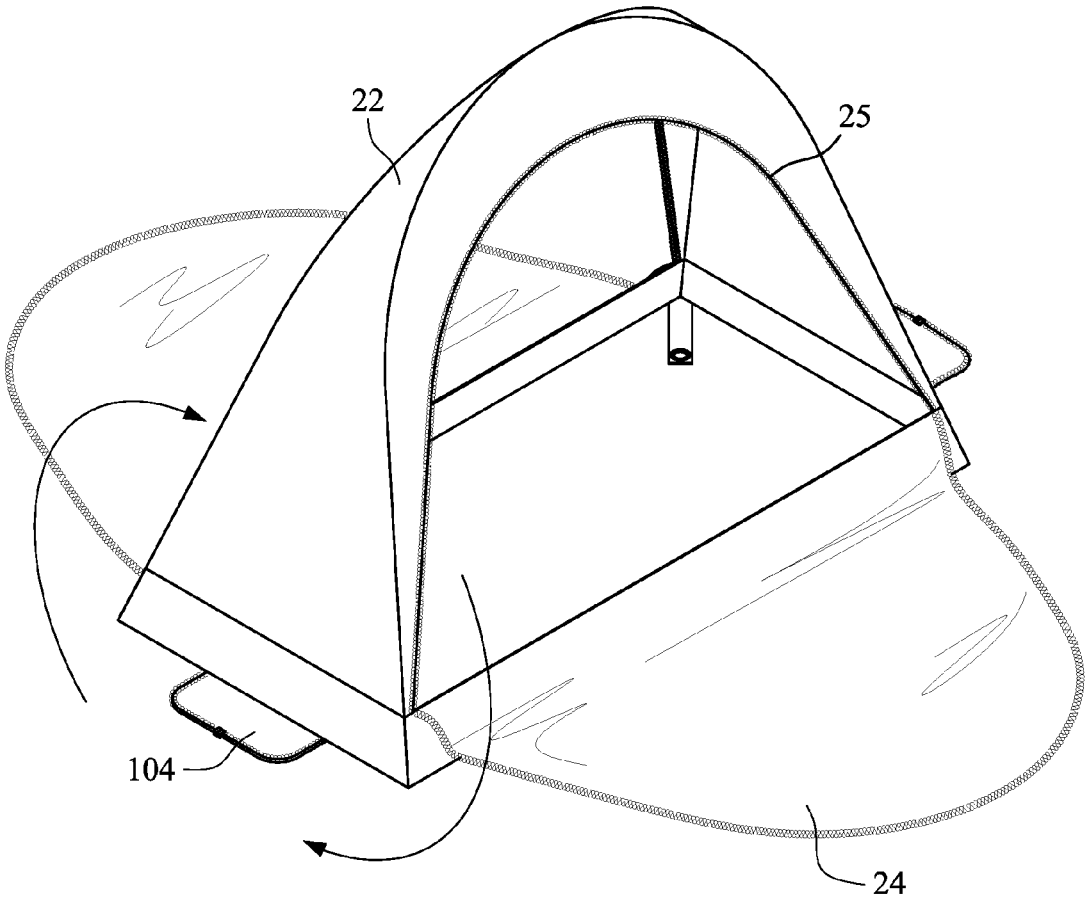
Figure 15:
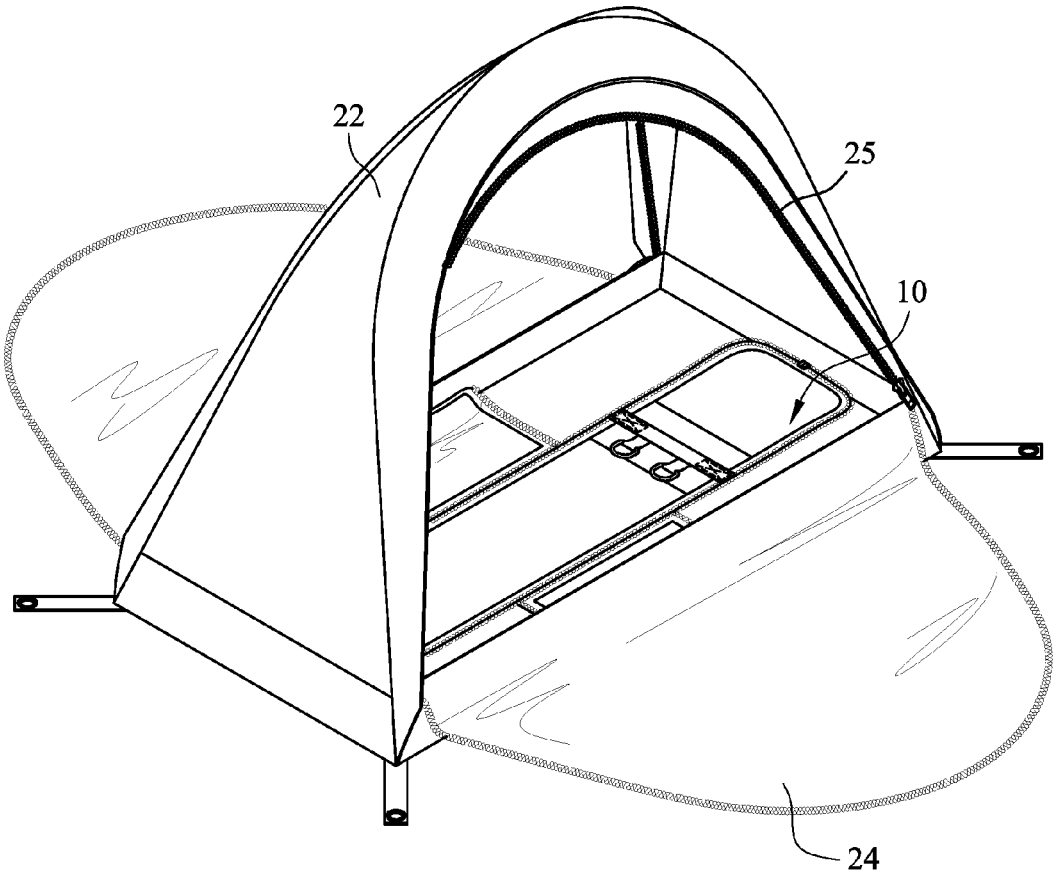

Please refer to FIG. 14, the bottom of the tent structure is integrated with the backpack body 10, and includes a tent opening 24 and a tent connector 25. When the tent structure is taken out, the inner surface is toward outside. The tent structure may be turn inside out, as shown in FIG. 15. Therefore, the backpack structure will not be soiled.

Figure 16:
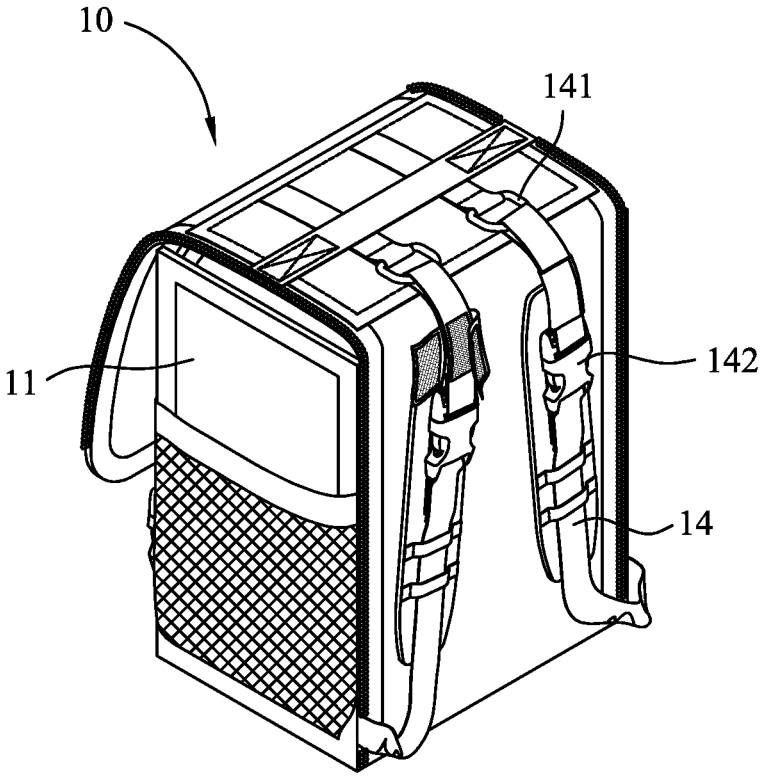
FIGS. 16-18 are schematic views of the shoulder straps of the backpack structure of the present invention.
Figure 17:
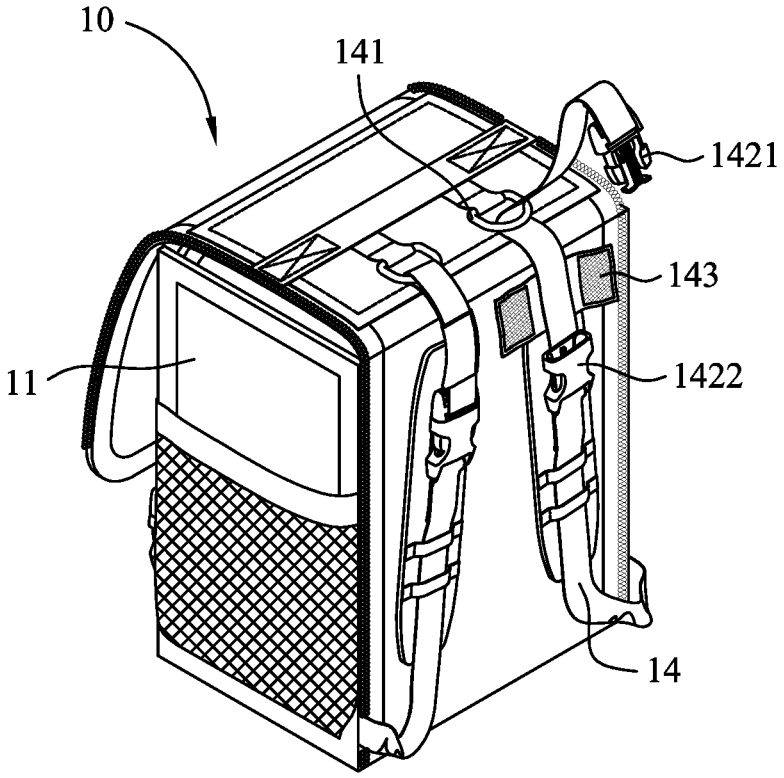
Figure 18:
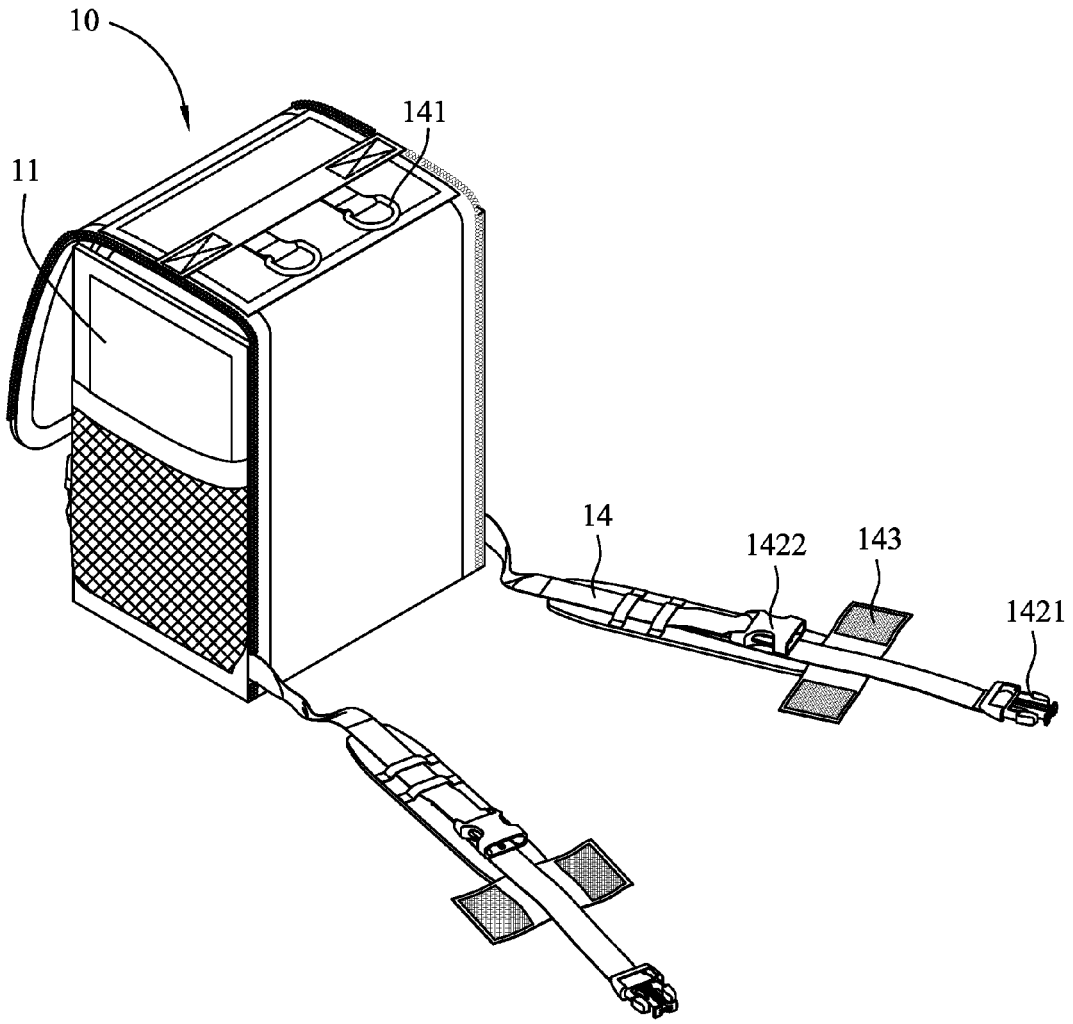

FIGS. 16-18 are schematic views of the shoulder straps of the backpack structure of the present invention.

The shoulder strap 14 includes a ring 102, a buckle assembly 142 and a strap fixing member 143. The ring 102 is attached to the backpack body 10. The shoulder strap 14 is inserted to the ring 102 and folded to be fastened by the buckle assembly 142. The buckle assembly 142 includes a male buckle member 1421 and a female buckle member 1422 to be mounted together. The strap fixing member 143 is used to fix the shoulder strap 14 after the male buckle member 1421 and the female buckle member 1422 are mounted together. When the shoulder strap 14 is to be detached, the strap fixing member 143 has to be opened. And the male buckle member 1421 and the female buckle member 1422 are dismounted. The shoulder strap 14 may be drawn out.

Figure 19:
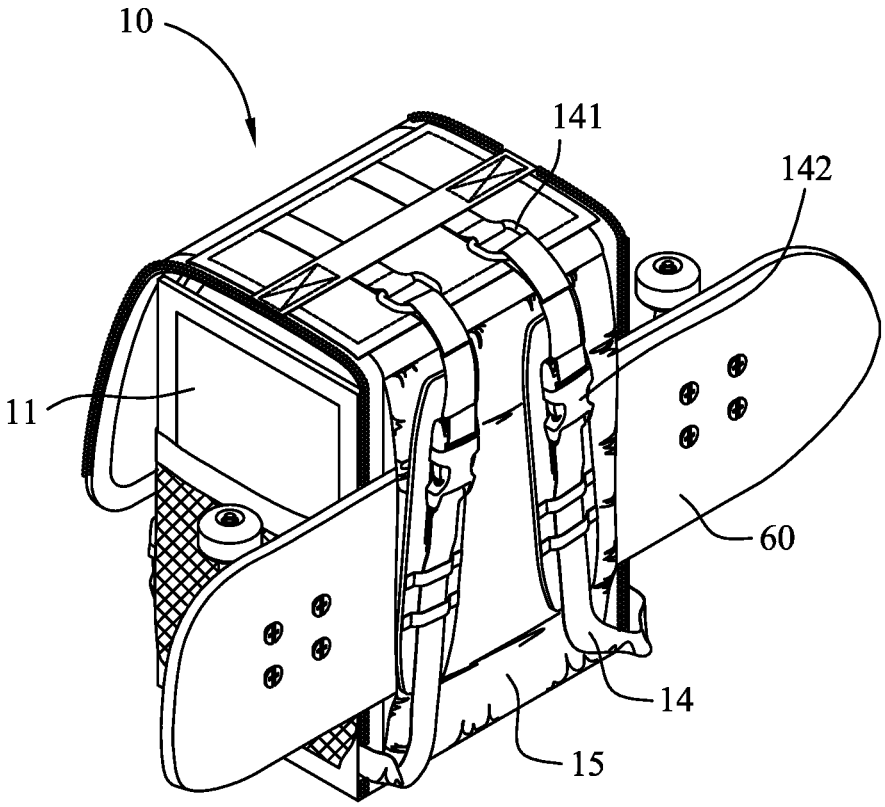
FIG. 19 is a schematic view of the back compartment of the backpack structure of the present invention.

FIG. 19 is a schematic view of the back compartment of the backpack structure of the present invention. The backpack body 10 further includes a back compartment 15 to carry objections 60. The objection 60 is flat, such as a aquaplane or a skateboard.

Figure 20:
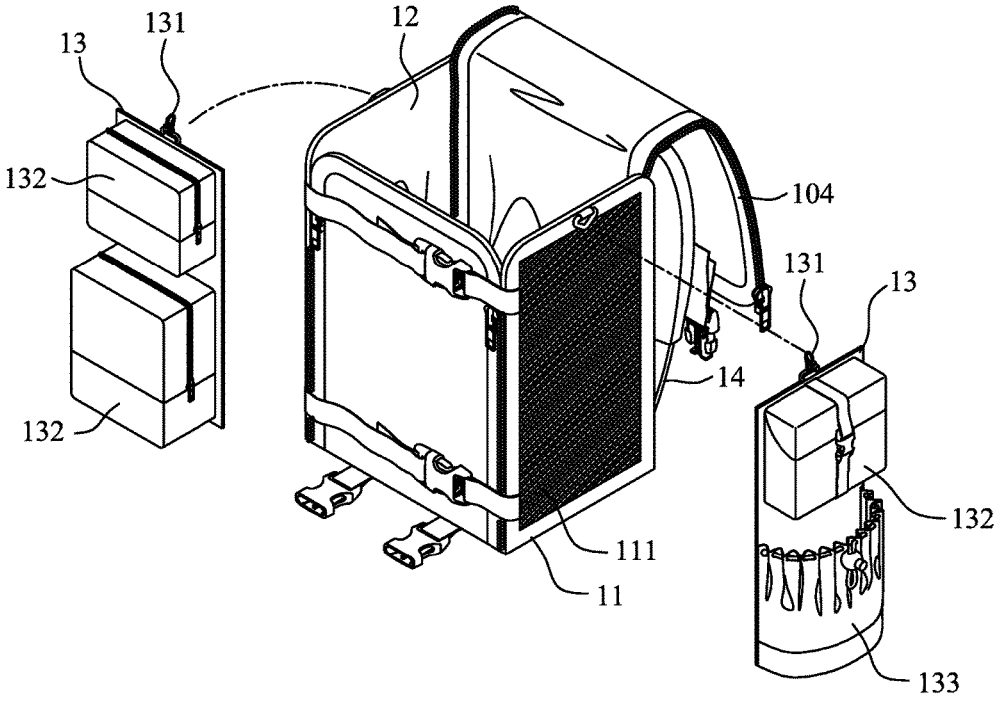
FIG. 20 is a schematic view of the side compartment of the backpack structure of the present invention.

FIG. 20 is a schematic view of the side compartment of the backpack structure of the present invention. The backpack body 10 further includes a side compartment 13 disposed on a left sidewall 11 or a right sidewall 12. The side compartment 13 is disposed on the left sidewall 11 or the right sidewall 12 by an attachment structure 111, such as a velcro or buckles. Also, the side compartment 13 is disposed on the backpack body 10 by a hook 131. The side compartment 13 includes a variety of containers, such as closed bags 132 and drawstring bags 133 with different sizes. The hook 131 may be utilized to hang other objections when the side compartments 13 are not in use.

Figure 21:
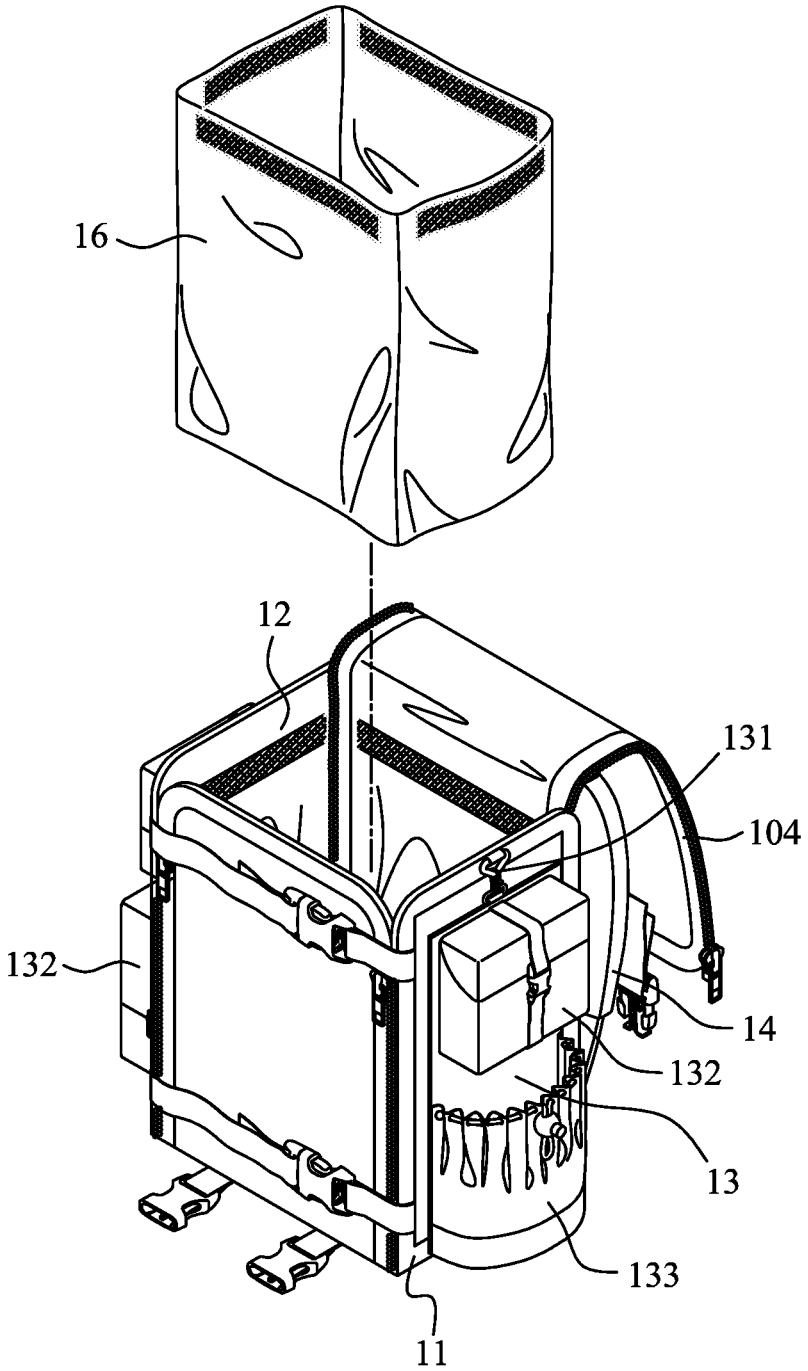
FIG. 21 is a schematic view of the inner bag of the backpack structure of the present invention.

FIG. 21 is a schematic view of the inner bag of the backpack structure of the present invention. The backpack body 10 may has a removably attached inner bag 16. The inner bag 16 is located at the storage space and may has a waterproof function. When the backpack body 10 is unfolded, the inner bag 16 is taken off to prevent the objections stored inside the backpack body 10 to fall out.

Figure 22:
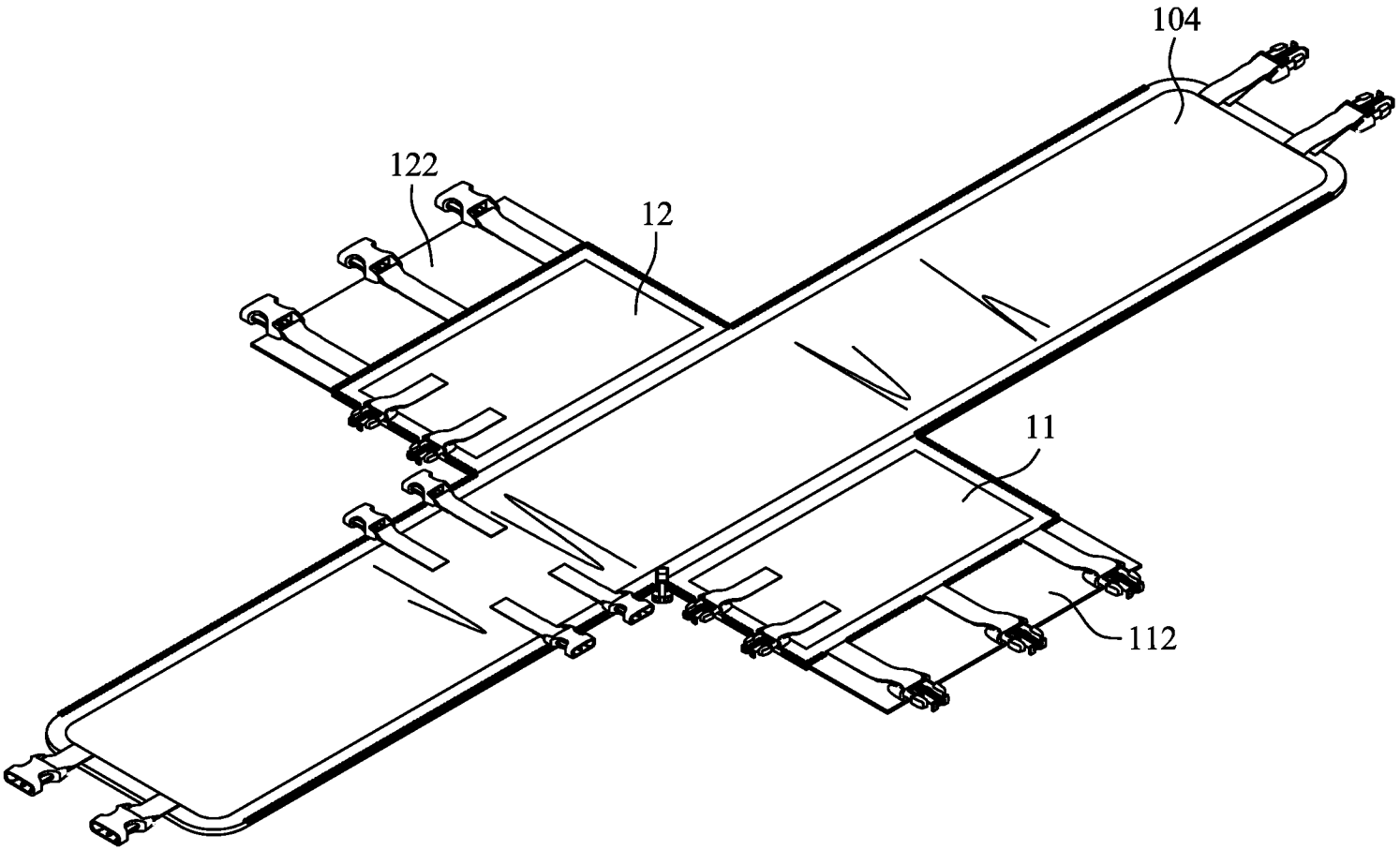
FIG. 22 is an exploded view of the extended enforcement structures of backpack structure of the present invention.
Figure 23:
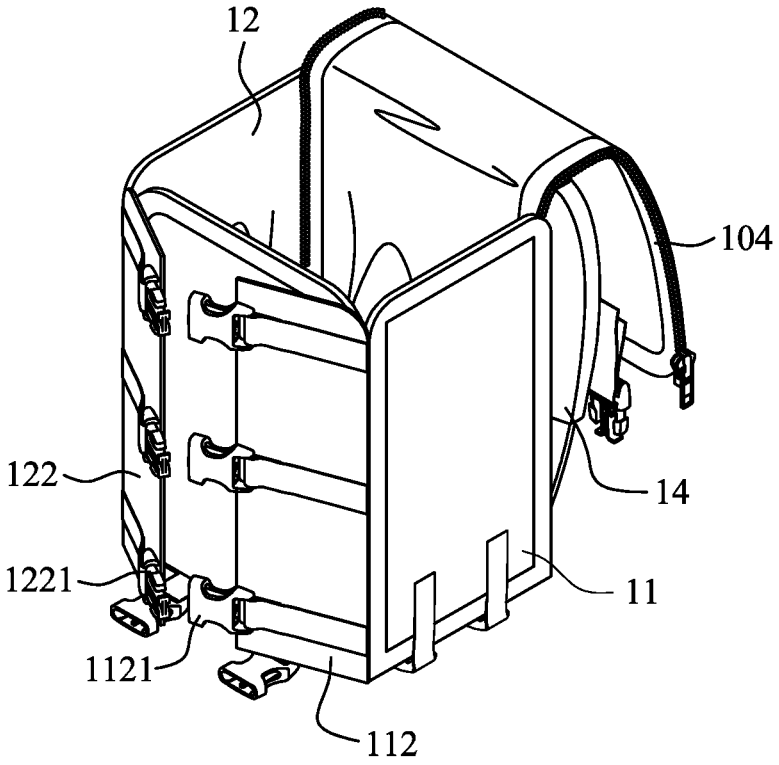
FIG. 23 is a schematic view of the extended enforcement structures of backpack structure of the present invention.

FIG. 22 is an exploded view of the extended enforcement structures of backpack structure of the present invention. To enhance the strength of the the left sidewall 11 and the right sidewall 12, the backpack body 10 has two extended enforcement structures disposed on the left sidewall 11 and the right sidewall 12. The left sidewall 11 has the left extended enforcement structure 112, and the right sidewall 13 has the right extended enforcement structure 122. Each of the extended enforcement structures 112 and 113 has a male enforcement buckle member 1121 and a female enforcement buckle member 1221 to share the loads of the connections of the backpack structure. Please also see FIG. 23, which is a schematic of the extended enforcement structures of backpack structure of the present invention.

Figure 24:
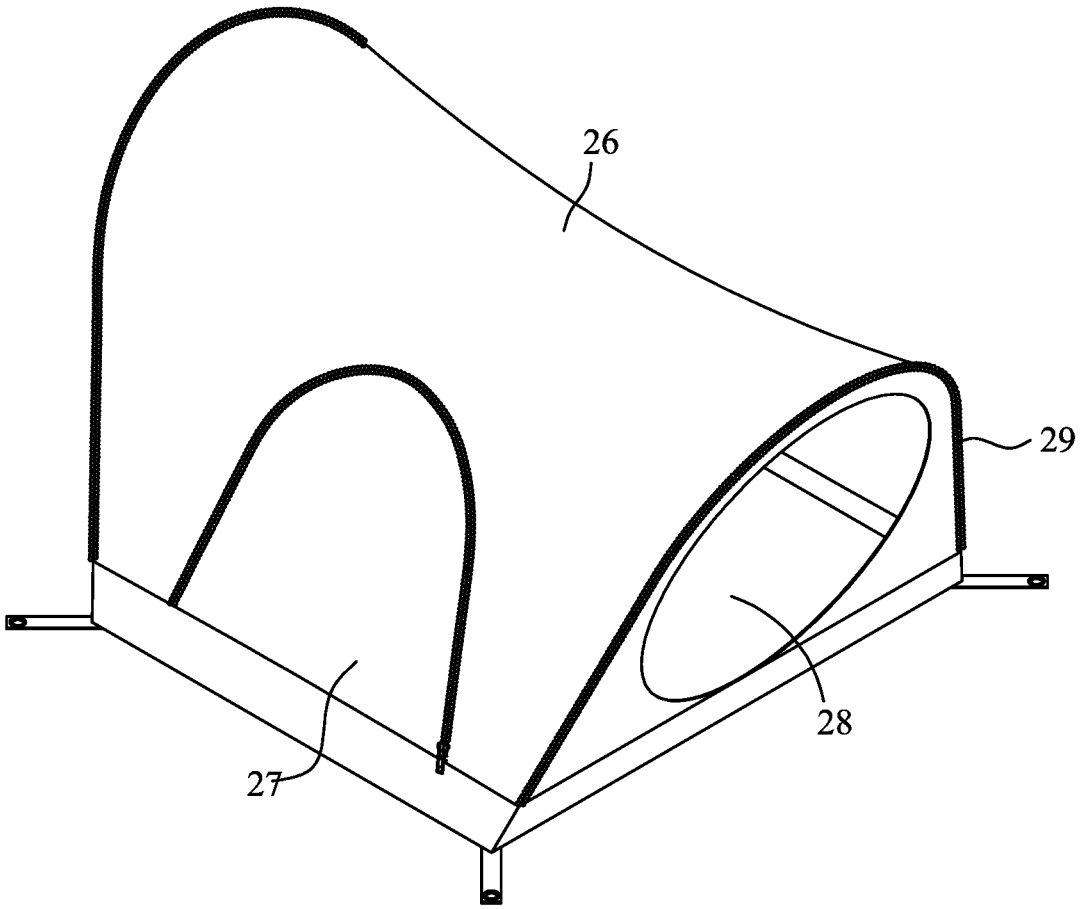
FIG. 24 is a schematic view of the tent extension portion of backpack structure of the present invention.

FIG. 24 is a schematic view of the tent extension portion of backpack structure of the present invention. The tent extension portion includes an extension portion body 26, an extension portion opening 27, an extension portion hole 28 and a plurality of extension portion connectors 29. The extension portion body 26 is tunnel-shaped and forms an activity space. The extension portion holes are disposed on the two sides of the extension portion body 26 to communicate the tent structure. The extension portion opening 27 is disposed on a suitable position of the extension portion body 26 to allow users passing the extension portion body 26. The extension portion connectors 29 are disposed on the extension portion body 26 to connect to the tent shells.

Figure 25:
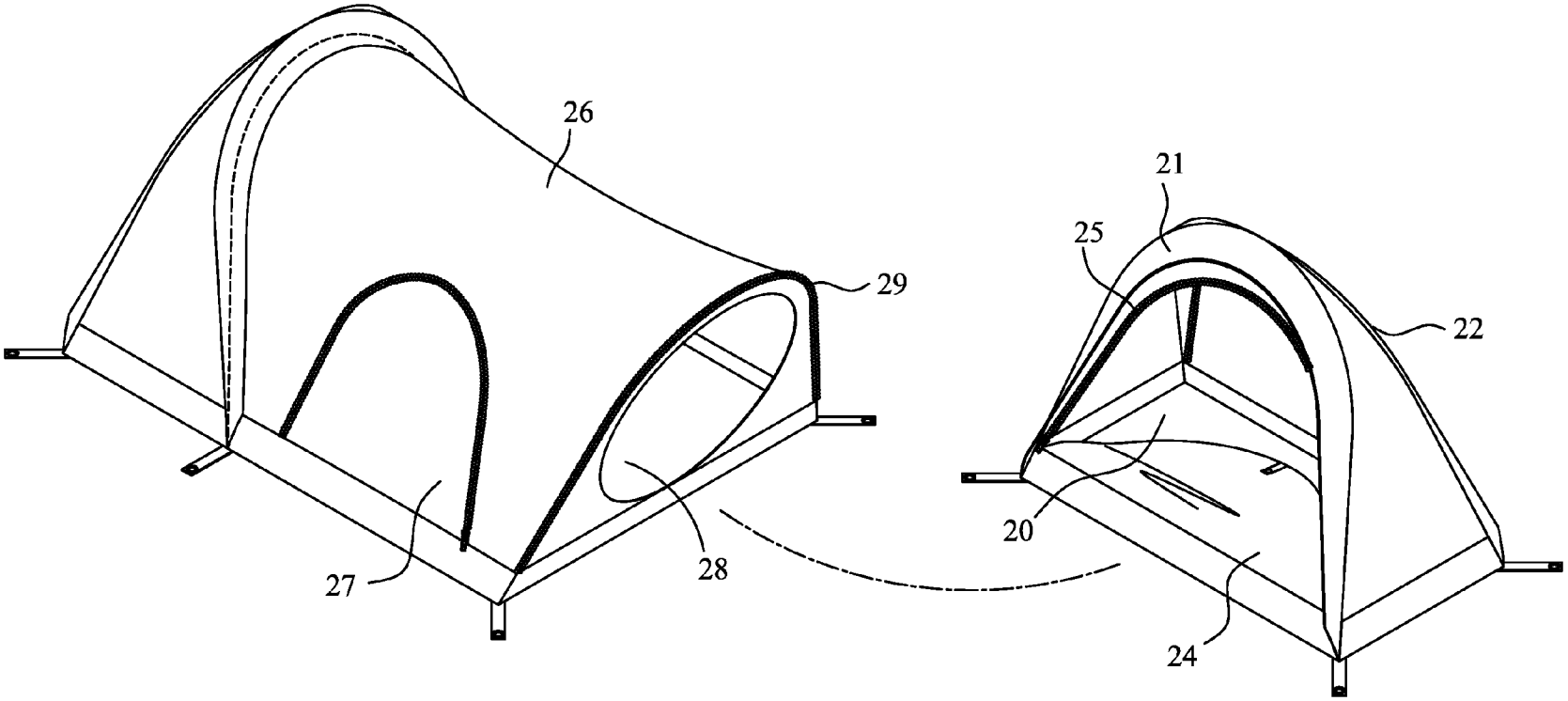
FIGS. 25-27 are schematic view of the tent extension portion of backpack structure of the present invention when in use.
Figure 26:
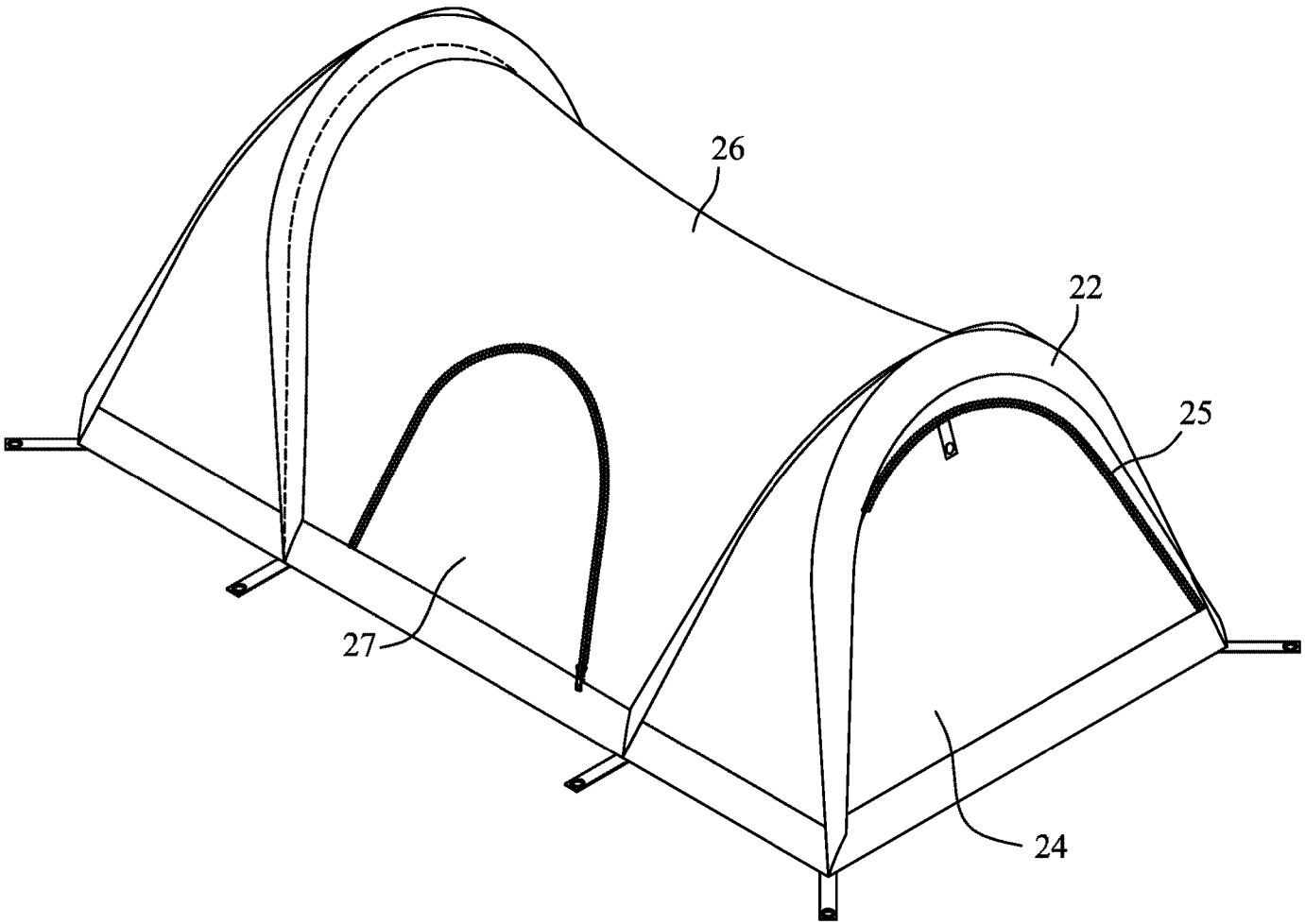
Figure 27:
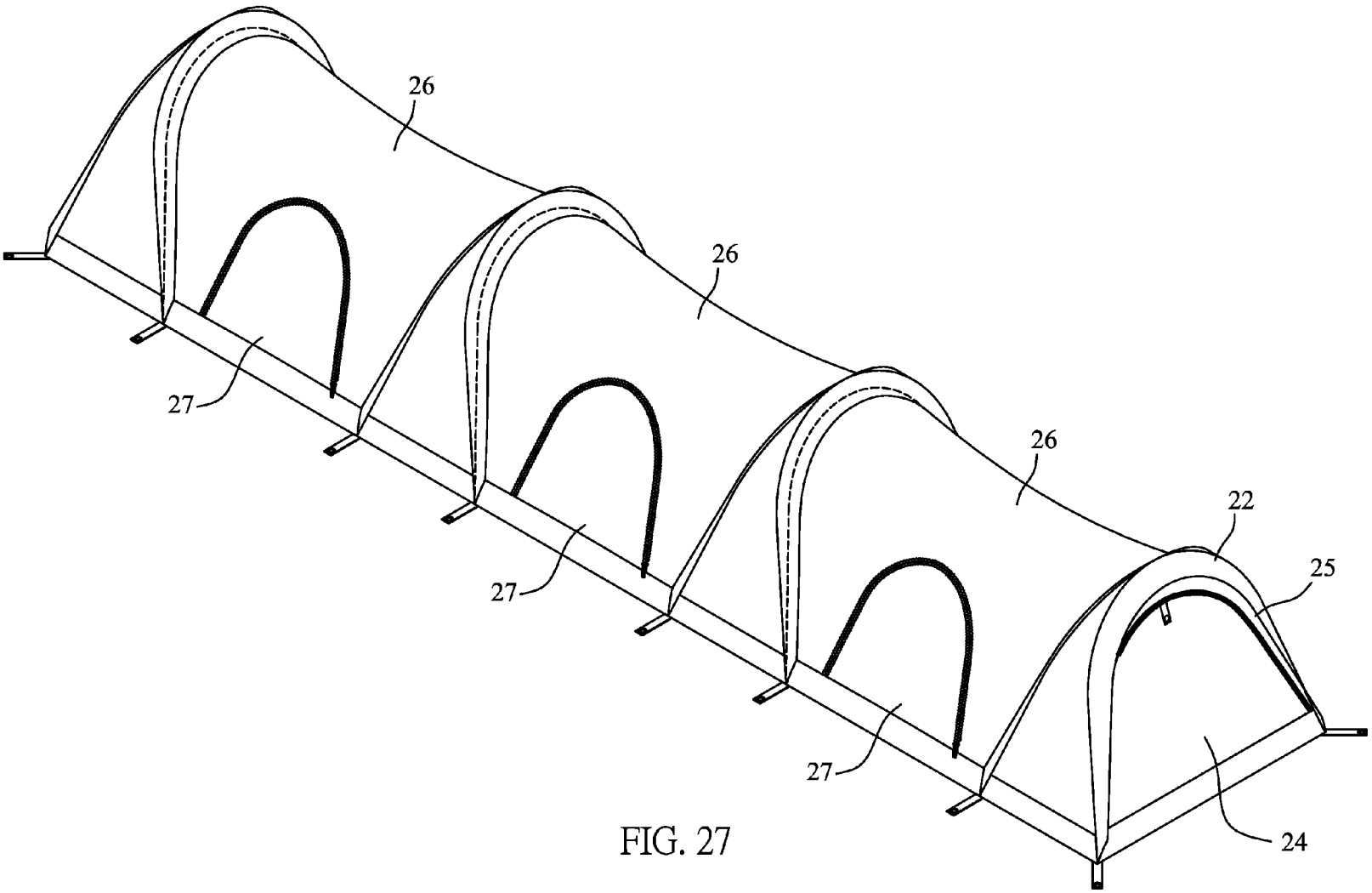

FIGS. 25-27 are schematic view of the tent extension portion of backpack structure of the present invention when in use. The unfolded tent includes a tent base 20, a left tent portion 21 and a right tent portion 22. As shown in FIG. 25, the left tent portion 21 has a tent opening 24 and a tent connector 25. The tent opening 24 is used to allow the users to enter the tent. The tent connector 25 is used to connect to the extension portion connectors 29. After connected, the tent opening 24 is communicated with the extension portion hole 28 to allow the users to pass. Also see FIG. 26.

Please refer to FIG. 27, the tent extension portions are used to connect several tents, according to this invention, to form a lager space for multiple persons.

Accordingly, the present invention provides a backpack structure. The backpack structure is integrated with the tent structure with the original function of carrying objections for the backpack. The tent structure is integrated within the backpack structure with large and uniform occupied area to distribute weight evenly. Also, the tent structure is made with light and waterproof material to reduce the weight. Each parts of the tent structure may be integrated with the backpack structure or may be detachable as a modular element. Moreover, the backpack structure may combine with a trolley structure for drawing easily, or the backpack structure may be designed as a luggage suitcase. The shoulder strap is detachable from the backpack body to improve comfortable when lie down thereabove. The compartment may has pads, made of cushioning materials, such as foam, to replace the camping mat. The tent extension portions are used to connect several tents to form a lager space for multiple persons.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A backpack structure, adapted to provide a storage space, comprising:

a backpack body, including a right connection portion and a left connection portion;

a left sidewall, connected to the backpack body by the left connection portion; and a right sidewall, connected to the backpack body by the right connection portion;

wherein the backpack body further includes a tent structure, the tent structure comprising:

a tent base; and a plurality of tent shells, attached to the tent base to form an inside space;

wherein the tent shells include a left tent portion and a right tent portion, the left tent portion is connected to the right tent portion and the left tent portion is stored within the left sidewall and the right tent portion is stored within the right sidewall.

2. The backpack structure of claim 1, wherein the tent structure further comprising a connecting portion to connect to a corresponding connecting portion of the backpack structure.

3. The backpack structure of claim 2, wherein the connecting portion is attached to the corresponding connecting portion by using buttons, zippers, or velcro.

4. The backpack structure of claim 1, wherein the tent base shows a printing pattern.

5. The backpack structure of claim 1, further comprising a snap structure to connect to a trolley structure.

6. The backpack structure of claim 5, wherein the trolley structure includes a trolley and a plurality of wheels.

7. The backpack structure of claim 1, wherein the backpack body further comprising a front cover strap to adjust a length of a front cover.

8. The backpack structure of claim 1, wherein the backpack body further comprising a shoulder strap which is detachable from the backpack body.

9. The backpack structure of claim 8, wherein the shoulder strap inserts to a ring of the backpack body and folded to be fastened by a buckle assembly.

10. The backpack structure of claim 9, wherein the buckle assembly includes a male buckle member and a female buckle member to be mounted together.

11. The backpack structure of claim 8, wherein the shoulder strap is fixed by a strap fixing member.

12. The backpack structure of claim 1, wherein the backpack body further comprising a compartment with a pad, the pad is made of cushioning material.

13. The backpack structure of claim 1, wherein the backpack body further comprising a back compartment to carry objects.

14. The backpack structure of claim 1, wherein the backpack body further comprising a side compartment attached to the left sidewall or the right sidewall.

15. The backpack structure of claim 14, wherein the side compartment is attached to the left sidewall or the right sidewall by an attachment structure or a hook.

16. The backpack structure of claim 1, wherein the backpack body further comprising two extended reinforcing structures attached to the left sidewall or the right sidewall to be connected each other to reinforce the backpack body.

17. The backpack structure of claim 16, wherein the extended reinforcing structures are connected each other to reinforce the backpack body by a male reinforcing buckle member and a female reinforcing buckle member.

18. The backpack structure of claim 1, wherein the backpack body further comprising a removably attached inner bag.

19. A backpack structure, adapted to provide a storage space and including a tent structure, the tent structure comprising:

a tent base;

a plurality of tent shells, attached to the tent base to form an inside space; and at least one tent extension portion, used to connect to another adjacent tent structure;

wherein the tent extension portion comprising:

an extension portion body, forming an activity space and having at least one extension portion hole to connect the tent structure;

at least one extension portion opening, disposed on the extension portion body to allow users passing the extension portion body; and a plurality of extension portion connectors, attached to the extension portion body to connect to the tent shells.

20. The backpack structure of claim 19, wherein the extension portion hole is used to connect to a tent opening of the tent shells.

21. The backpack structure of claim 19, wherein the extension portion connectors are used to connect to a tent connector of the tent shells.

* * * * *